US010271663B2

(12) United States Patent
Salazar et al.

(10) Patent No.: US 10,271,663 B2
(45) Date of Patent: Apr. 30, 2019

(54) INFANT CARRIER WITH CINCHABLE SLEEVE SEAT ADJUSTMENT

(71) Applicant: BLUE BOX OPCO LLC, San Diego, CA (US)

(72) Inventors: Maureen Salazar, Chicago, IL (US); Stacy Castro, Chicago, IL (US); Leslie Roeder, New York, NY (US)

(73) Assignee: BLUE BOX OPCO LLC, San Diego, CA (US)

( * ) Notice: Subject to any disclaimer, the term of this patent is extended or adjusted under 35 U.S.C. 154(b) by 0 days.

(21) Appl. No.: 15/360,729

(22) Filed: Nov. 23, 2016

(65) Prior Publication Data

US 2017/0150826 A1 Jun. 1, 2017

Related U.S. Application Data

(60) Provisional application No. 62/261,122, filed on Nov. 30, 2015, provisional application No. 62/367,824, filed on Jul. 28, 2016.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/158–160
See application file for complete search history.

(56) References Cited

U.S. PATENT DOCUMENTS

| | | | | |
|---|---|---|---|---|
| 4,234,229 | A | 11/1980 | Arnold | |
| 4,402,440 | A | 9/1983 | Purtzer et al. | |
| 4,434,920 | A | 3/1984 | Moore | |
| 4,469,259 | A | 9/1984 | Krich et al. | |
| D276,478 | S | 11/1984 | Fallon | |
| 4,492,326 | A | 1/1985 | Storm | |
| 4,986,458 | A | 1/1991 | Linday | |
| 5,361,952 | A | 11/1994 | Gold | |
| 5,522,528 | A | 6/1996 | Petricola | |
| 5,570,823 | A | 11/1996 | Lindy et al. | |
| 5,673,828 | A | 10/1997 | Raedel et al. | |
| 5,813,580 | A | 9/1998 | Fair | |
| 6,318,608 | B1 | 11/2001 | Fowler | |
| 6,415,969 | B1 | 7/2002 | Higuchi | |
| 7,252,214 | B2 | 8/2007 | Krogh et al. | |
| 7,284,503 | B2 | 10/2007 | Elmberg | |
| 7,766,199 | B1 | 8/2010 | Caperon | |
| 7,886,946 | B2 | 2/2011 | Gray | |
| 8,028,871 | B2 | 10/2011 | Gray | |
| 8,172,116 | B1 | 5/2012 | Lehan et al. | |
| 8,365,325 | B2 | 2/2013 | Schneider | |
| 8,424,732 | B1 | 4/2013 | Lehan et al. | |
| 8,453,894 | B2 * | 6/2013 | Jung | A47D 13/025 224/159 |

(Continued)

OTHER PUBLICATIONS

PCT Search Report and Written Opinion for PCT/US2016/063875, dated Feb. 3, 2017.

*Primary Examiner* — Adam J Waggenspack
(74) *Attorney, Agent, or Firm* — Stetina Brunda Garred and Brucker; Mark B. Garred

(57) ABSTRACT

An adjustable infant carrier which is outfitted with a cinchable sleeve adapted to allow for varying degrees of adjustability to the effective width of the seat portion of the carrier so as to accommodate children of differing size, as well as different support positions/configurations.

20 Claims, 17 Drawing Sheets

(56) References Cited

U.S. PATENT DOCUMENTS

| | | | | |
|---|---|---|---|---|
| 8,590,757 | B2 | 11/2013 | Frost | |
| 8,701,949 | B1 * | 4/2014 | Lehan | A45F 3/047 224/160 |
| 9,022,260 | B2 | 5/2015 | Frost | |
| 9,185,993 | B2 | 11/2015 | Telford et al. | |
| 2007/0029356 | A1 | 2/2007 | Moriguchi et al. | |
| 2008/0283559 | A1 | 11/2008 | Parness et al. | |
| 2009/0101683 | A1 | 4/2009 | Gilboa et al. | |
| 2010/0147910 | A1 | 6/2010 | Schachtner | |
| 2010/0308088 | A1 | 12/2010 | Lindblom | |
| 2011/0042429 | A1 | 2/2011 | Frost | |
| 2011/0101051 | A1 | 5/2011 | Parness et al. | |
| 2011/0290831 | A1 | 12/2011 | Wang | |
| 2012/0043359 | A1 | 2/2012 | Bergkvist et al. | |
| 2012/0199619 | A1 | 8/2012 | Zack | |
| 2013/0023810 | A1 | 1/2013 | Schmid et al. | |
| 2013/0284783 | A1 | 10/2013 | Burpee | |
| 2014/0263491 | A1 | 9/2014 | Telford et al. | |
| 2014/0284361 | A1 | 9/2014 | Wang | |
| 2015/0223614 | A1 * | 8/2015 | Pos | A47D 13/02 224/158 |

* cited by examiner

INFANT CARRIER WITH CINCHABLE SLEEVE SEAT ADJUSTMENT

CROSS-REFERENCE TO RELATED APPLICATIONS

The present application claims priority to U.S. Provisional Patent Application Ser. No. 62/261,122 entitled INFANT CARRIER WITH CINCHABLE SLEEVE SEAT ADJUSTMENT filed Nov. 30, 2015, and U.S. Provisional Patent Application Ser. No. 62/367,824 entitled INFANT CARRIER WITH CINCHABLE SLEEVE SEAT ADJUSTMENT filed Jul. 28, 2016.

STATEMENT RE: FEDERALLY SPONSORED RESEARCH/DEVELOPMENT

Not Applicable

BACKGROUND

1. Technical Field

The present disclosure generally relates to an infant carrier and, more particularly, to an infant carrier which is outfitted with a cinchable sleeve adapted to allow for varying degrees of adjustability to the effective width of the seat portion of the carrier.

2. Description of the Related Art

It is common practice for parents and other caregivers to carry infants and toddlers, and there is a variety of well-known infant carrier products in the prior art which are configured to be worn by an adult for on-the-body carrying of the infant or toddler. These products include slings, wraps, pouches, and backpack-like devices outfitted with shoulder strap devices in varying configurations and arrangements. Shoulder-supported infant carriers are particularly growing in popularity for supporting or transporting an infant or young child. A common attribute of these carriers is that they typically offer "hands free" operation, and allow the adult wearer to carry the infant while performing other activities. Therefore, shoulder-supported infant carriers typically provide immediate benefits to the parent/caregiver, including the freedom to use both hands while monitoring and caring for the child being carried. Care may be provided to other children simultaneously, strain and fatigue on the arms, back, and shoulders may be reduced, and household chores may be completed while monitoring the child. Moreover, cumbersome and bulky strollers need not be deployed in places such as crowded city sidewalks and public transportation systems.

Shoulder supported infant carriers, as currently known in the art, come in a wide range of designs and styles. One currently known infant carrier is a frame-type carrier which typically supports the infant on the back of the wearer. Currently, more popular than frame-type carriers, are frameless or soft-sided carriers which typically provide more comfort to the wearer and the infant.

Although soft-sided carriers have become a popular means for transporting an infant, most soft-sided carriers suffer from one or more drawbacks. For instance, one common drawback associated with conventional soft-sided carriers is that the seat portion of the carrier is of a fixed size. Therefore, as the infant grows, the seat portion of the carrier may become too small, or when the infant is young, the seat portion of the carrier may be configured to support a larger infant, and thus, may be too big. Furthermore, the fixed nature of the seat portion on conventional infant carriers may limit the adaptability achievable by the infant carriers, i.e., the infant carrier may not be easily or comfortably adaptable in both front carry and rear carry configurations.

Though various attempts have been made in the prior art to address the aforementioned drawback, the seat portion adjustability solutions that have been arrived at to date suffer their own drawbacks. In greater detail, in many carriers providing adjustability in the width of the seat portion, such adjustability is facilitated by the selective folding and unfolding of flaps. Typically, when the flaps are folded and thus not deployed, they overlap other portions of the carrier, resulting in the seat portion being at its minimal available width. Conversely, the unfolding of the flaps and attachment thereof to prescribe portions of the carrier effectively maximizes the available width of the seat portion. However, the manipulation of the flaps between their stowed and deployed states is typically a cumbersome task, with there being virtually no available measure of width adjustability of the seat portion between the two extremes achieved when the flaps are either stowed or deployed. The infant carrier described below addresses this drawback through its inclusion of a cinchable sleeve adapted to allow for varying degrees of adjustability to the effective width of the seat portion of the carrier in a quick and easy manner. These and other aspects of the present infant carrier will be discussed in more detail below.

BRIEF SUMMARY

Various aspects of the present disclosure are directed toward an adjustable infant carrier which is outfitted with a cinchable sleeve adapted to allow for varying degrees of adjustability to the effective width of the seat portion of the carrier so as to accommodate children of differing size, as well as different support positions/configurations.

According to one embodiment of the present disclosure, the adjustable infant carrier comprises a main body panel defining a seat portion and an elongate sleeve which extends along the seat portion and includes opposed ends. The carrier further comprises an elongate waist belt which is extensible about the waist of a wearer, and includes a portion advanced through the sleeve. The carrier further comprises a pair of shoulder straps which are extensible over the wearer's shoulders, and each have opposed first and second end portions coupled to respective, prescribed regions of the main body panel. In the carrier, a portion of the sleeve is rigidly attached to the waist belt such that the sleeve defines separate first and second sleeve sections which are each slidably, adjustably positionable along a corresponding portion of the waist belt advanced therethrough. In greater detail, each of the first and second sleeve sections is slidably, adjustably positionable between a fully expanded state maximizing the width of the seat portion, a fully collapsed state minimizing the width of the seat portion, and a multiplicity of partially expanded states between the fully expanded and collapsed states.

The infant carrier further preferably comprises a pair of anchoring tabs which are attached to protrude from respective ones of the opposed ends of the sleeve, and a pair of tab attachments which are attached to the waist belt proximate respective ones of the opposed ends of the sleeve. The attachment of one of the anchoring tabs to a respective one of the tab attachments is operative to generally maintain a corresponding one of the first and second sleeve sections in its fully expanded state. In one implementation, each of the anchoring tabs has a tab hole disposed therein, with each of the tab attachments comprising a tab button. In this regard, the receipt of one of the tab buttons into a respective one of the tab holes is operative to generally maintain a corresponding one of the first and second sleeve sections in its fully expanded state. The receipt of the tab buttons in respective ones of the tab holes is further operative to prevent the first and second sleeve sections from rotating downward under the weight of the legs of an infant being carried in the carrier.

The infant carrier further preferably comprises a pair of leg opening flaps which are attached to the waist belt proximate respective ones of the opposed ends of the sleeve, and a pair of flap attachments which are attached to the main body panel in spaced relation to each other. Each of the leg opening flaps is selectively movable between a stowed state extending in overlapping relative to a portion of the waist belt and covering a respective one of the tab attachments, and a deployed state extending from the waist belt into engagement with a respective one of the flap attachments. The main body panel and leg opening flaps collectively define a spaced pair of leg openings when the leg opening flaps are each in the deployed state. In one implementation, each of the leg opening flaps has a flap hole disposed therein, with each of the flap attachments comprising a flap button. In this regard, the receipt of one of the flap buttons into a respective one of the flap holes is operative to generally maintain a corresponding one of the leg opening flaps in its deployed state.

The infant carrier further preferably comprises on auxiliary body panel which is attached to the main body panel and is foldable relative thereto from an extended state to a folded state. When in the folded state, the auxiliary body panel at least partially overlaps the main body panel.

According to another embodiment of the present disclosure, the adjustable infant carrier comprises a main body panel defining a seat portion and an elongate sleeve which extends along the seat portion and includes opposed ends. The carrier further comprises an elongate waist belt which is extensible about the waist of a wearer, and includes a portion advanced through the sleeve. The carrier further comprises a pair of shoulder straps which are extensible over the wearer's shoulders, and each have a first end portion coupled to respective, prescribed regions of the main body panel. The shoulder straps are extensible through corresponding loops or side rings attached to other respective, prescribed regions of the main body panel, and thereafter may be tied to each other at the front or back of the wearer in a sash-like arrangement as effectively maintains the carrier on the wearer's body. In the carrier, a portion of the sleeve is rigidly attached to the waist belt such that the sleeve defines separate first and second sleeve sections which are each slidably, adjustably positionable along a corresponding portion of the waist belt advanced therethrough. In greater detail, each of the first and second sleeve sections is slidably, adjustably positionable between a fully expanded state maximizing the width of the seat portion, a fully collapsed state minimizing the width of the seat portion, and a multiplicity of partially expanded states between the fully expanded and collapsed states.

In the infant carrier of this alternative embodiment, the main body panel is outfitted with a spaced pair of height adjustment strap assemblies. Each of these strap assemblies comprises an elongate adjustment strap which is advanced through a corresponding, complimentary sleeve defined by the main body panel. One end portion of the adjustment strap is attached to a prescribed region of the main body panel, with the opposite end portion protruding from an open end of the corresponding sleeve and being cooperatively engaged to a corresponding retention cam which is itself attached to a prescribed region of the main body panel and selectively movable between locked and unlocked positions. The movement of the retention cam to the unlocked position allows the corresponding adjustment strap to pulled therethrough in either of two opposite directions as allows for the selective cinching of the main body panel into a reduced height profile or, conversely, the stretching or expansion of the main body panel into a full height profile. The movement of the retention cam to its locked position effectively maintains the main body panel in its particular height profile corresponding to the relative position of the adjustment strap thereto. As will be recognized, the manipulation of the main body panel into any particular height profile is facilitated by manipulating both of the strap assemblies such that orientations of the locked cams along the lengths of the corresponding adjustment straps is approximately the same.

According to yet another embodiment of the present disclosure, the adjustable infant carrier comprises a main body panel defining a seat portion and an elongate sleeve which extends along the seat portion and includes opposed ends. The carrier further comprises an elongate waist belt which is extensible about the waist of a wearer, and includes a portion advanced through the sleeve. The carrier further comprises a pair of shoulder straps which are extensible over the wearer's shoulders, and each have a first end portion coupled to respective, prescribed regions of the main body panel. The shoulder straps are crisscrossed over the wearer's back such that the two points of attachment to the main body panel defined by each shoulder strap are at respective ones of opposed sides of the main body panel. In the carrier, a portion of the sleeve may be rigidly attached to the waist belt such that the sleeve defines separate first and second sleeve sections which are each slidably, adjustably positionable along a corresponding portion of the waist belt advanced therethrough. In greater detail, each of the first and second sleeve sections may be slidably, adjustably positionable between a fully expanded state maximizing the width of the seat portion, a fully collapsed state minimizing the width of the seat portion, and a multiplicity of partially expanded states between the fully expanded and collapsed states.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
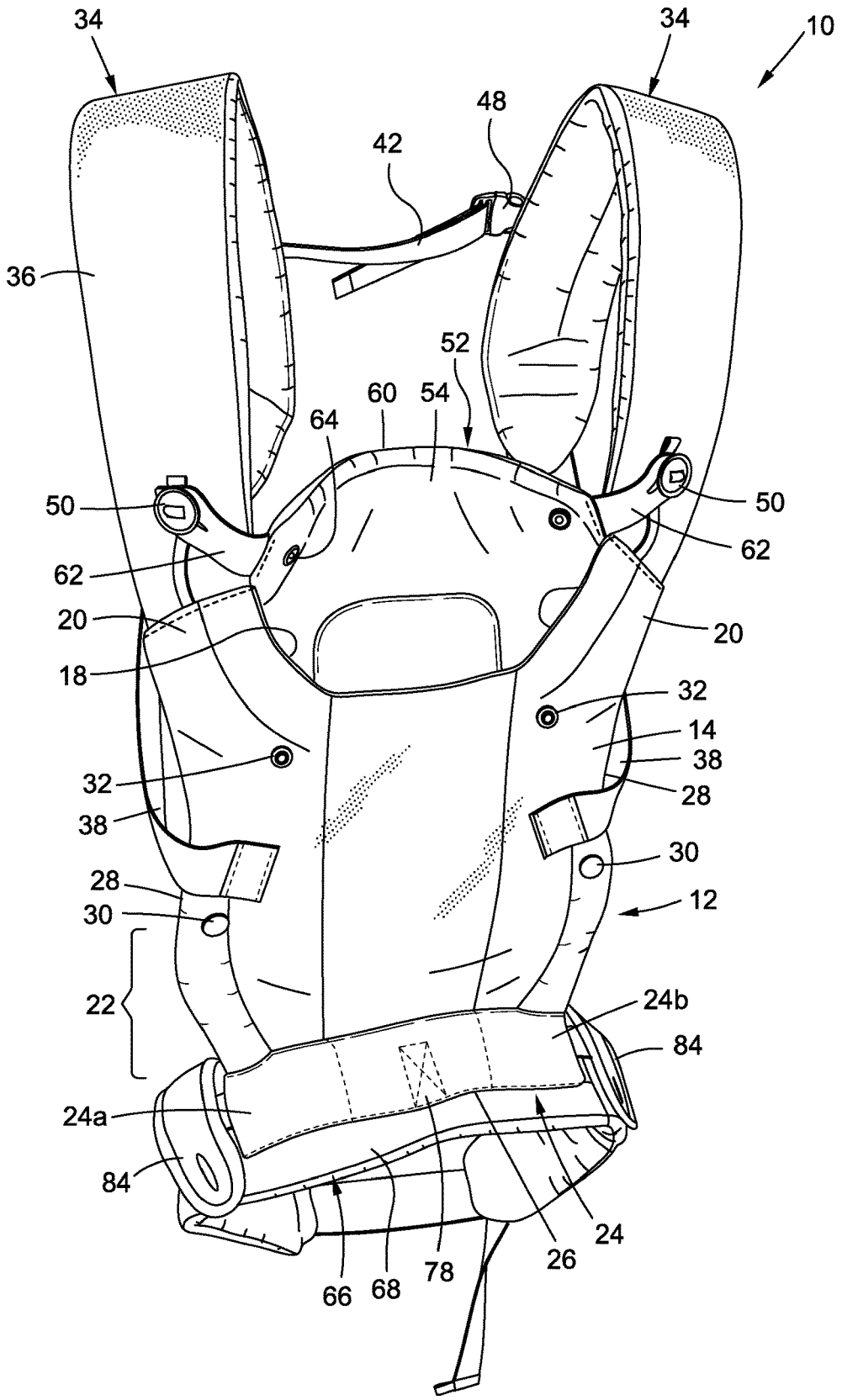
FIG. 1 is a front view of an adjustable infant carrier constructed in accordance with the present disclosure, the seat portion of the carrier being depicted at its maximum width, with the leg opening flaps of the carrier each being depicted in the stowed state.

Referring now to the drawings, wherein the showings are for purposes of illustrating various embodiments of the present disclosure only, and are not for purposes of limiting the same, there is depicted an adjustable infant carrier 10 constructed in accordance with one embodiment the present disclosure. The infant carrier 10 is specifically configured and adapted to provide enhanced adjustability and ease-of-use relative to conventional infant carriers. More specifically, the infant carrier 10 is outfitted with a structural features described with particularity below which are adapted to allow for varying degrees of adjustability to the effective width of the seat portion of the carrier so as to accommodate children of differing size, as well as different support positions/configurations. The infant carrier 10 is additionally configured to be worn in both front and back carry configurations.

Referring now to the FIGS. 1-7, the carrier 10 comprises a main body panel 12 defining an exteriorly presented outer surface 14, and an opposed, interiorly presented inner surface 16. When viewed from the perspective shown in FIG. 1, the main body portion 12 further defines an arcuately contoured, generally concave top edge segment 18, the opposed ends of which terminate at respective ones of the spaced pair of corner regions 20. In this regard, the top edge segment 18 and corner regions 20 collectively define the top edge of the main body panel 12. As also viewed from the perspective shown in FIG. 1, approximately the lower third of the main body panel 12 defines a seat portion 22 thereof, the use of which will be described in more detail below.

The main body panel 12 further includes an elongate, tubular sleeve 24 which, as also viewed from the perspective shown in FIG. 1, extends along the length of the lower edge or boundary of the seat portion 22, the sleeve 24 and the seat portion 22 thus being of substantially equal width. In the carrier 10, the sleeve 24 defines the bottom edge 26 of the main body panel 12. The main body panel 12 further defines an opposed pair of side edges 28 which each extend between the top edge of the main body panel 12 as collectively defined by the top edge segment 18 and corner regions 20, and the bottom edge 26 as defined by the sleeve 24. Along these lines, and as is perhaps most apparent from FIG. 1, the width of the bottom edge 26 of the main body panel 12 is less than the width of top edge of the main body panel 12. Stated another way, when viewed from the perspective shown in FIG. 1, the distance separating the points at which each of the two side edges 28 intersect the top edge at respective ones of the corner regions 20 is greater than the distance between the opposed ends of the bottom edge 26 which correspond to respective ones of the opposed ends of the sleeve 24. Thus, the side edges 28 are not generally parallel to each other in the main body panel 12, but rather are tapered inwardly as they transition from the top edge of the main body panel 12 to the bottom edge 26 thereof. Those of ordinary skill in the art will recognize that the sleeve 24 may comprise an independent structure attached to the remainder of the main body panel 12, or may be defined by a portion of the main body panel 12.

Disposed on the outer surface 14 of the main body panel 12 is an identically configured, horizontally aligned pair of a flap attachments and, more particularly, flap buttons 30. In greater detail, each of the flap buttons 30 is attached to the outer surface 14 in relative close proximity to a respective one of the side edges 28, and at approximately the upper boundary of the seat portion 22 of the main body panel 12. Also disposed on the outer surface 14 of the main body panel 12 is an identically configured, horizontally aligned pair of connectors and, more particularly, male snaps 32. In greater detail, each of the snaps 32 is attached to the outer surface 14 in relative close proximity to the deepest portion of the recessed top edge segment 18 of the main body panel 12. The use of both the flap buttons 30 and snaps 32 will be described in more detail below.

The carrier 10 further comprises an identically configured pair of shoulder straps 34 which are adapted to be extensible over respective ones of the wearer's shoulders. Each of the shoulder straps 34 preferably has a two-piece construction. In greater detail, each of the shoulder straps 34 comprises a primary segment 36 which is of a relatively wide and relatively thick padded construction, preferably fabricated from two opposed layers of a soft yet durable fabric material having a padded layer therebetween, the peripheral edges of the fabric layers being secured to each other through the use of stitching. As is most apparent from FIGS. 1 and 3-5, one end portion of the primary segment 36 of each shoulder strap 34 is attached to a respective one of the corner regions 20 of the main body panel 12.

Figure 7:
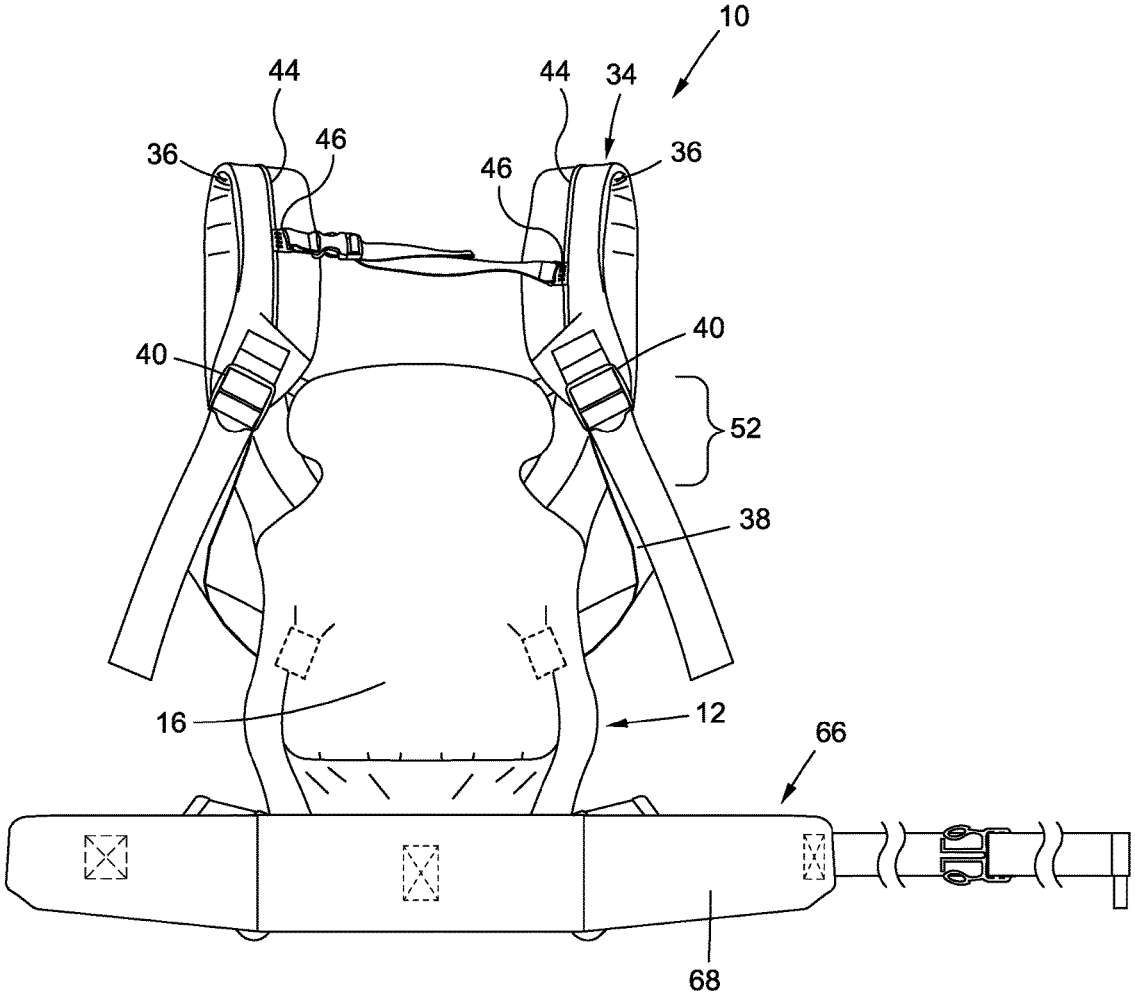
FIG. 7 is a rear view of the infant carrier.
Figure 8:
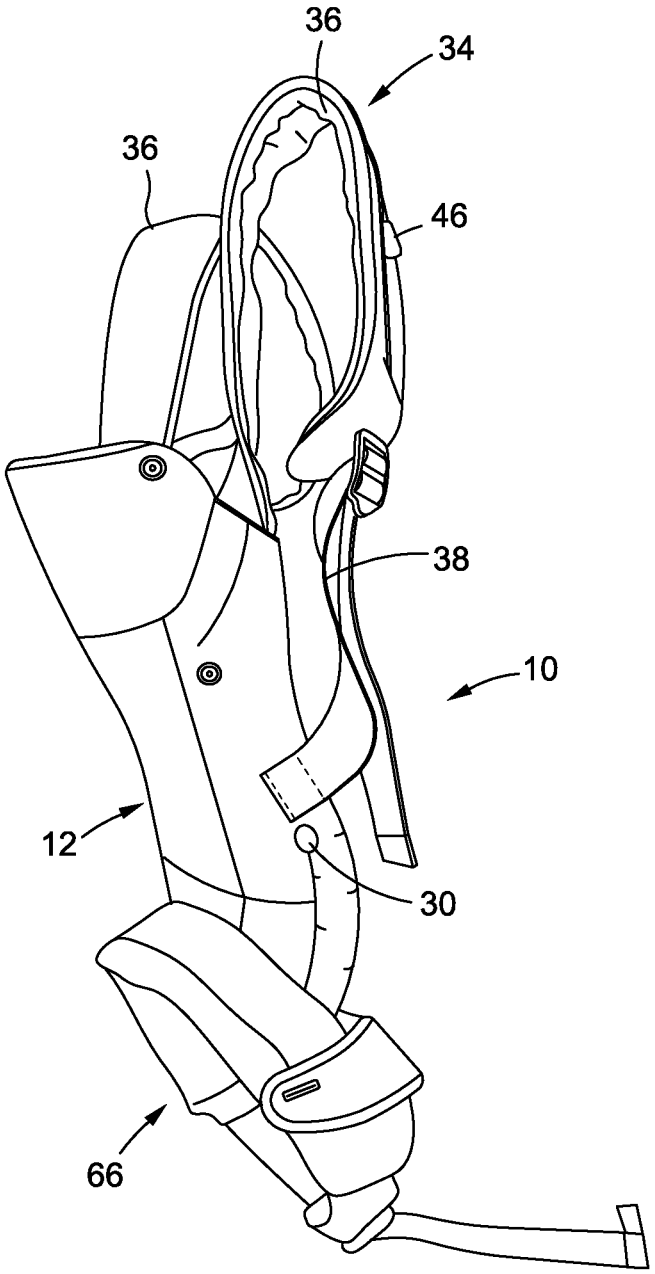
FIG. 8 is a side view of the infant carrier.

In addition to the primary segment 36, each shoulder strap 34 includes a secondary segment 38 which is of a narrower and thinner construction in comparison to the corresponding primary segment 36. Within each shoulder strap 34, one end portion of the secondary segment 38 is attached to that end portion of the corresponding primary segment 36 opposite the end portion attached to a respective one of the corner regions 20. As best seen in FIG. 1, the opposite end portion of the secondary segment 38 is attached to the outer surface 14 of the main body panel 12 at a location just above a respective one of the flap buttons 30. The attachment of the primary and secondary segments 36, 38 of each shoulder strap 34 to each other, and to the main body panel 12, is preferably facilitated through the use of stitching. As best seen in FIG. 7, the secondary segments 38 each have a buckle 40 integrated therein that allows for the overall adjustability in the length of the corresponding shoulder strap 34.

Figure 6:
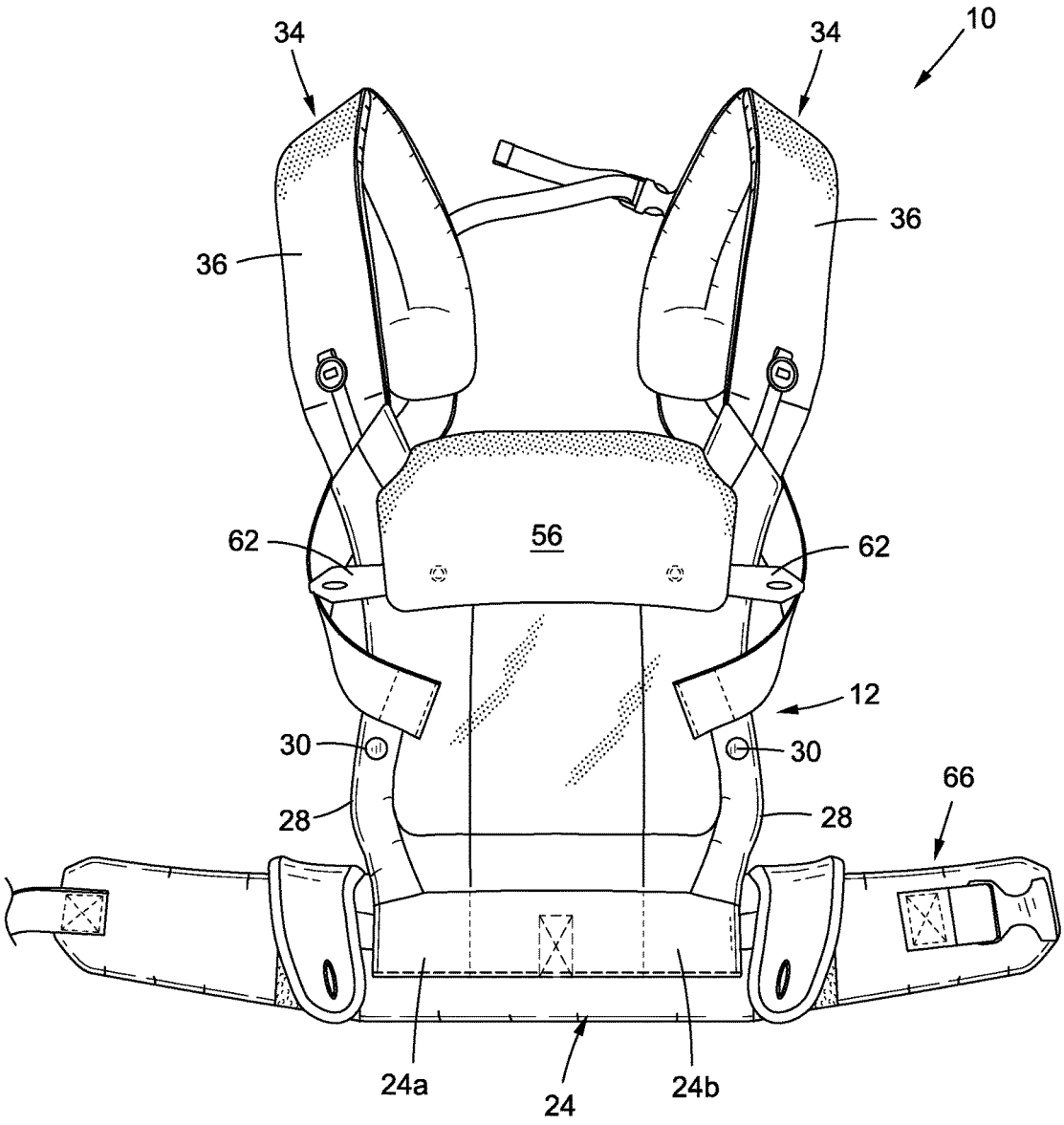
FIG. 6 is a front view of the infant carrier depicting the auxiliary body panel thereof in its folded state.

As seen in FIGS. 6 and 7, the carrier 10 is further provided with a cross strap 42 which extends between and selectively interconnects the shoulder straps 34. In greater detail, as best seen in FIG. 7, the primary segment 36 of each shoulder strap 34 includes an elongate, bead or cord-like segment 44 which protrudes from the exterior surface thereof, and extends partially there along in a lengthwise direction. The opposed ends of the cross strap 42 are each outfitted with a slide coupler 46 which is cooperatively engaged to and slidably positionable along the length of a respective one of the segments 44. As will be recognized by those of ordinary skill in the art, the cooperative engagement of the cross strap 42 to each of the shoulder straps 34 via the engagement of the slide couplers 46 to respective ones of the segments 44 allows for variability or adjustability in the positioning of the cross strap 42 relative to the shoulder straps 34. The cross strap 42 preferably includes a buckle 48 comprising male and female connectors integrated therein. As will be recognized, the detachment of the male and female connectors of the buckle 48 from each other effectively separates the cross strap 42 into two independent segments coupled to respective ones of the primary segments 36 via respective ones of the slide couplers 46. Securing the male and female connectors of the buckle 48 to each other as facilitates the continuous extension of the cross strap 42 between the shoulder straps 34 assists in maintaining the shoulder straps 34, and in particular the primary segments 36 thereof, in a relatively fixed spatial relationship relative to each other. The manner in which the buckle 48 is integrated into the cross strap 42 allows for adjustability in the fixed length of the cross strap 42 as it extends between the primary segments 36 of the shoulder straps 34.

As seen in FIGS. 1 and 3-5, the primary segment 36 of each of the shoulder straps 34 also includes a panel fastener and, more particularly, a panel button 50 attached to the exterior surface thereof. In greater detail, each panel button 50 is attached to the primary segment 36 of the corresponding shoulder strap 34 proximate a respective one of the corner regions 20 defined by the main body panel 12. The use of the panel buttons 50 will also be described in more detail below.

Figure 3:
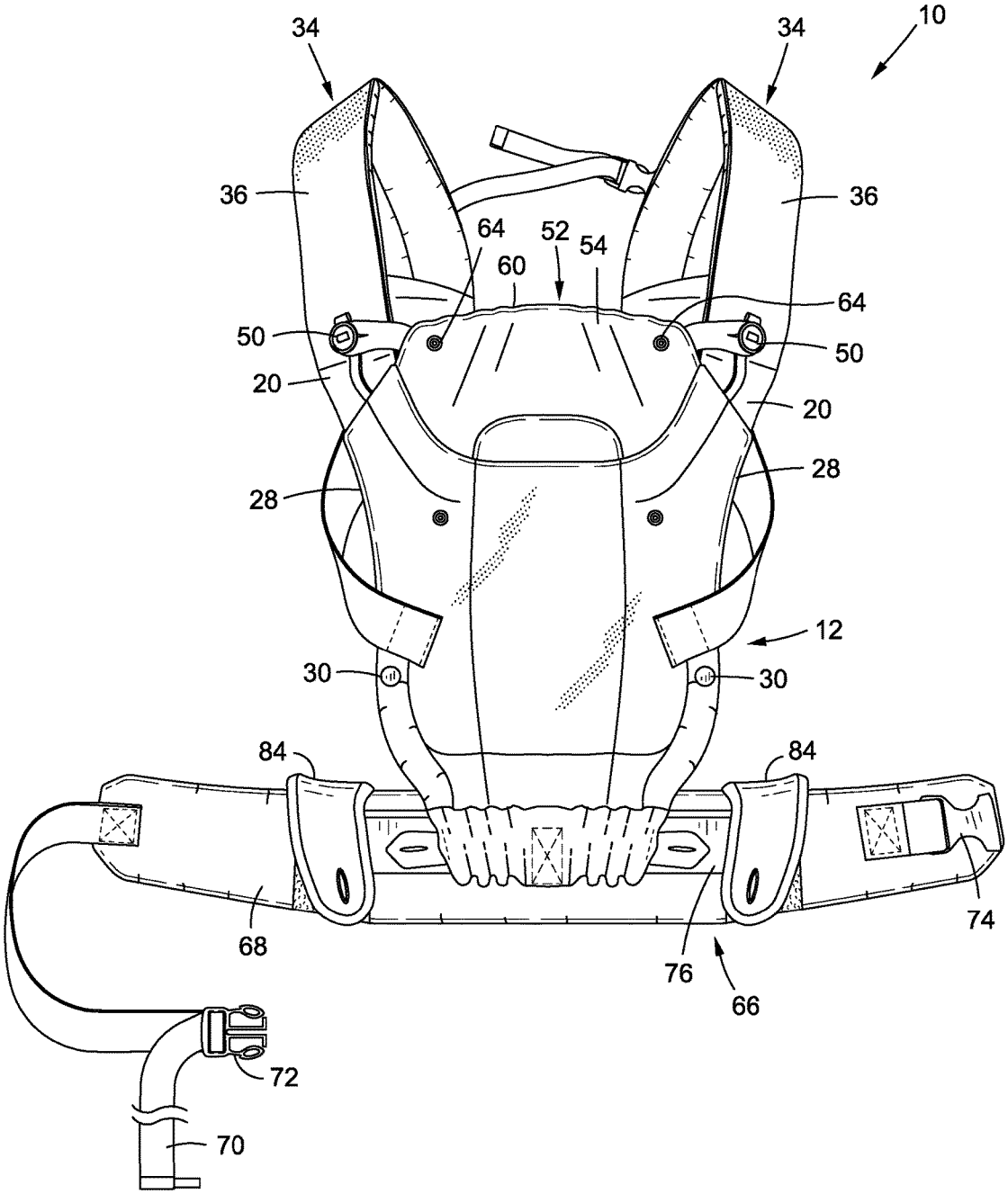
FIG. 3 is a front view of the infant carrier also similar to FIG. 1, but depicting the seat portion of the carrier at its minimum width, with the leg opening flaps of the carrier each being depicted in the stowed state.
Figure 4:
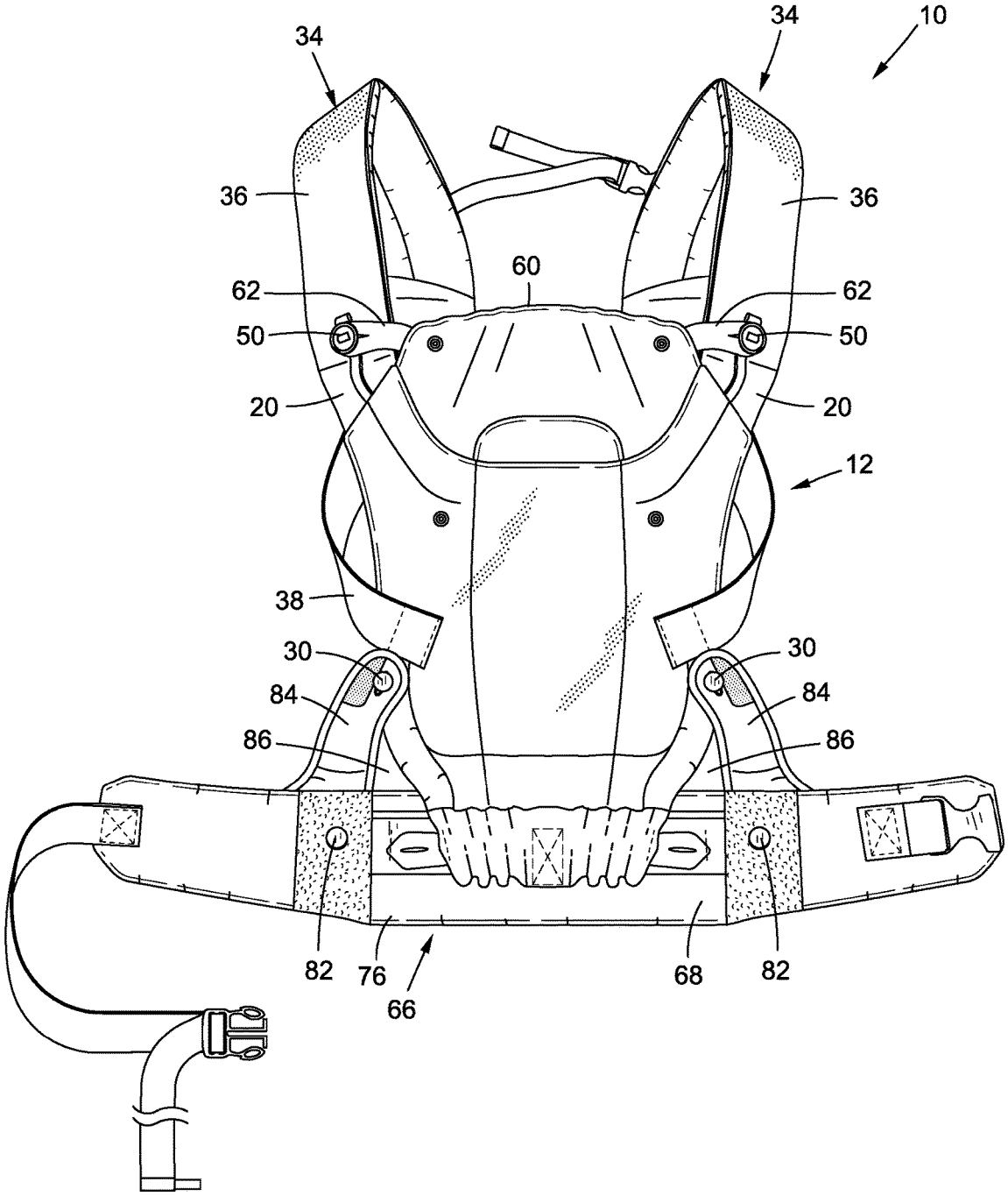
FIG. 4 is a front view of the infant carrier similar to FIG. 3 depicting the seat portion of the carrier at its minimum width, but also depicting the leg opening flaps of the carrier in the deployed state as cooperatively engaged to the main body panel of the carrier.
Figure 5:
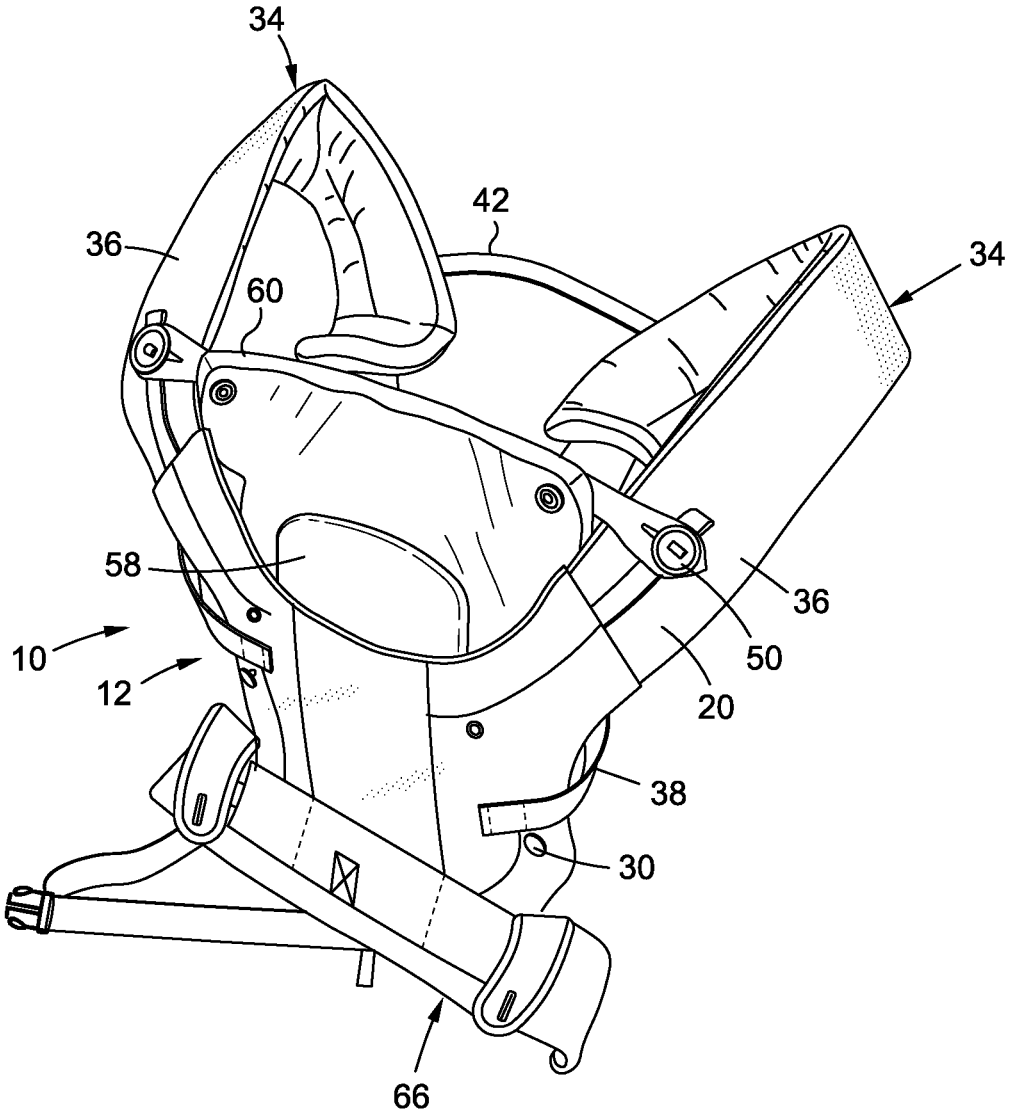
FIG. 5 is a top perspective view of the infant carrier depicting the auxiliary body panel thereof in its extended state.

The carrier 10 further comprises an auxiliary body panel 52 which is connected to the main body panel 12 and is foldable relative thereto from an extended state (as shown in FIGS. 3-5) to a folded state (as shown in FIG. 6). As is apparent from FIG. 6, when the auxiliary body panel 52 is in its folded state, it at least partially overlaps the main body panel 12 and, more particularly, the outer surface 14 of the main body panel 12. Like the main body panel 12, the auxiliary body panel 52, when in its extended state, defines an exteriorly presented outer surface 54 and an opposed, interiorly presented inner surface 56. The carrier 10 is uniquely constructed such that the outer surfaces 14, 54 of the main and auxiliary body panels 12, 52 are defined by separate fabric layers, whereas the inner surface 56 of the auxiliary body panel 52 and the majority of the inner surface 16 of the main body panel 12 are defined by a common fabric layer. Along these lines, a relatively small section of the inner surface 16 of the main body panel 12 which extends to the top edge segment 18 and faces the outer surface 54 of the auxiliary body panel 52 is defined by a separate fabric layer, and not that fabric layer commonly defining the inner surface 56 of the auxiliary panel 52.

In the carrier 10, the main and auxiliary body panels 12, 52 collectively define a pocket 58. More particularly, the pocket 58 is defined by a portion of the outer surface 54 of the auxiliary body panel 52 and the aforementioned small section of the inner surface 16 of the main body panel 12 which extends to the top edge segment 18.

When also viewed from the perspective shown in FIG. 1, the auxiliary body panel 52 further defines an arcuately contoured, generally convex top edge 60. Disposed on the outer surface 54 of the auxiliary body panel 52 proximate the top edge 60 is an identically configured, horizontally aligned pair of connectors and, more particularly, female snaps 64. In addition, protruding from opposite ends of the top edge 60 is a pair of panel anchors 62, each of which has an anchor hole disposed therein. Each of the panel anchors 62 is adapted to be releasably engageable to a respective one of the panel buttons 50 in the manner shown in FIGS. 1 and 3-5. In this regard, the advancement of the panel buttons 52 through the anchor holes of respective ones of the panel anchors 62 effectively maintains the auxiliary body panel 52 in its extended state. The detachment or uncoupling of the panel anchors 62 from the panel buttons 50 allows the auxiliary body panel 52 to be transitioned from its extended state to its folded state. The auxiliary body panel 52 is maintainable in its folded state as shown in FIG. 6 by the releasable engagement of the female snaps 64 thereof to respective ones of the male snaps 32 included on the outer surface 14 of the main body panel 12. In the folded state shown in FIG. 6, at least a portion of the outer surface 54 of the auxiliary body panel 52 is directed toward or faces a portion of the outer surface 14 of the main body panel 12, with a portion of the inner surface 56 of the auxiliary body panel 52 being outwardly or exterior presented. As will be discussed in more detail below and as will be recognized by those of ordinary skill in the art, the positioning of the auxiliary body panel 52 and its extended state provides a greater measure of support to the head of an infant carried within the carrier 10.

The carrier 10 further comprises an elongate waist belt 66 which it is extensible about the waist of a wearer. The waist belt 66 preferably comprises a primary belt segment 68 which is of a relatively wide and relatively thick padded construction, preferably fabricated from two opposed layers of the soft yet durable fabric material having a padded letter therebetween, the peripheral edges of the fabric layers being secured to each other through the use of stitching. As seen in FIG. 3, the waist belt 66 also includes a coupling belt segment 70 which is attached to and protrudes from one end portion of the primary belt segment 68, and is of a narrower and thinner construction in comparison to the primary belt segment 68. Attached to and selectively positionable along the length of the coupling belt segment 70 is a male connector 72 which is releasably engageable to a complementary female connector 74 attached to that end portion of the primary belt segment 68 opposite that having the coupling belt segment 70 protruding therefrom. As will be recognized, the coupling of the male and female connectors 72, 74 to each other effectively maintains the waist belt 66 in a closed-loop configuration, the circumference of which can be selectively increased or decreased through the adjustments of the positioning of the male connector 72 on the coupling belt segment 70.

In addition to the primary and coupling belt segments 68, 70, the waist belt 66 also includes a secondary belt segment 76 which is of a narrower and thinner construction in comparison to the primary belt segment 68. As best seen in FIGS. 3 and 4, the secondary belt segment 76 extends in a lengthwise direction along a central portion of the exteriorly presented outer surface of the primary belt segment 68. In the waist belt 66, the opposed ends of the secondary belt segment 76 are attached to the primary belt segment 68 such that a majority of the length of the secondary belt segment 76 is separable from the underlying primary belt segment 68.

Figure 2:
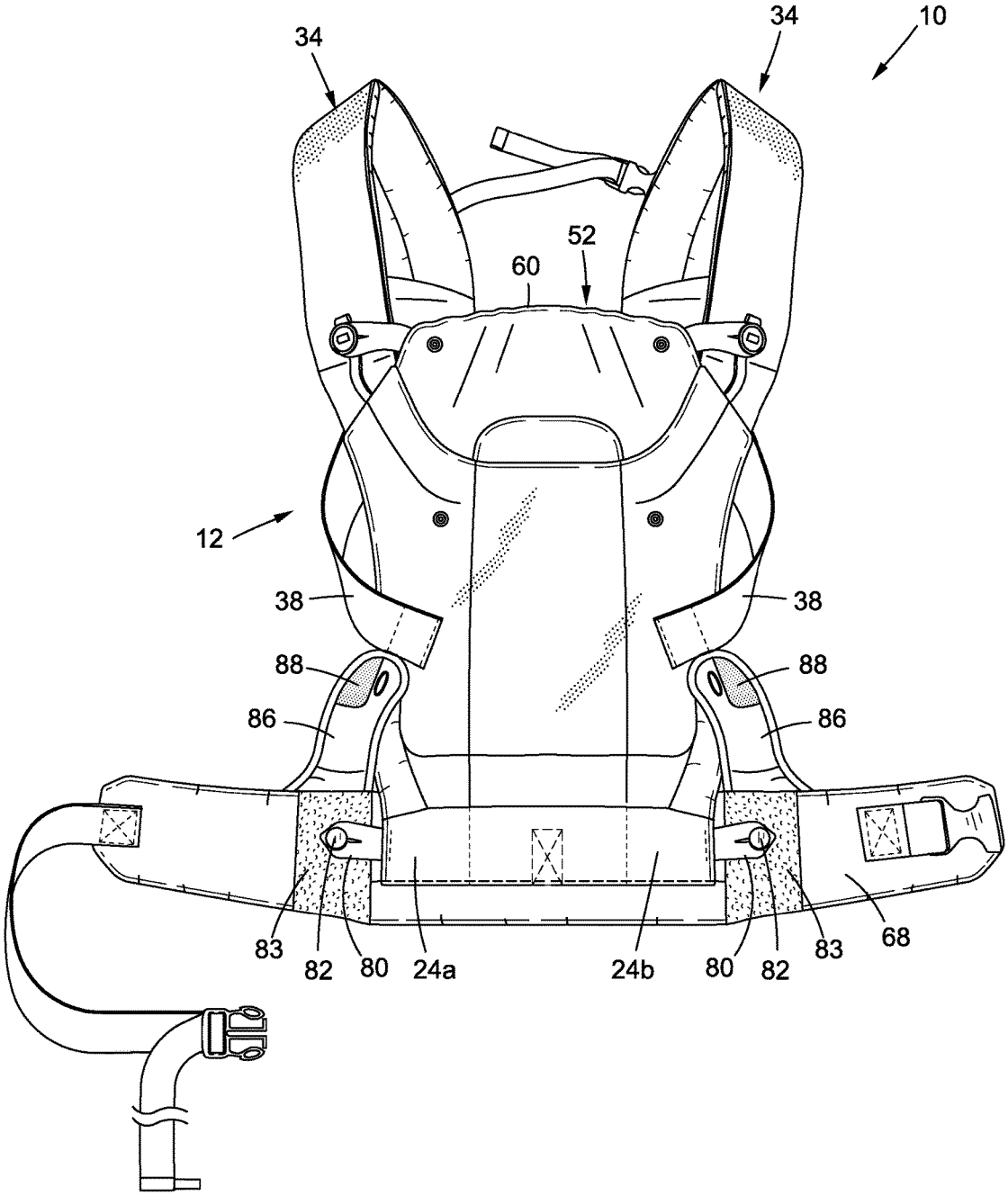
FIG. 2 is a front view of the infant carrier similar to FIG. 1, but depicting the leg opening flaps as each being moved toward the deployed state to reveal the anchoring tabs of the carrier attached to corresponding tab attachments thereof as maintains each of the first and second sleeve sections of the sleeve of the carrier in its fully expanded state.

In the carrier 10, the main body panel 12, and in particular the sleeve 24 thereof, is adjustably attached to a waist belt 66. In greater detail, the secondary belt segment 76 of the waist belt 66 is advanced through the sleeve 24. Importantly, as seen in FIGS. 1 and 2, in the carrier 10, a central portion of the sleeve 24, as well as a central section of the secondary belt segment 76, are each rigidly attached to the primary belt segment 68 of the waist belt 66, preferably through the use of stitching 78. Such attachment assists in preventing the rotation of the sleeve 24 about the secondary belt segment 76 advanced therethrough, and further results in the sleeve 24 defining separate first and second sleeve sections 24*a*, 24*b* which are each slidably, adjustably positionable along a corresponding portion of the secondary belt segment 76. In greater detail, each of the first and second sleeve sections 24*a*, 24*b* is movable between a fully expanded state (shown in FIGS. 1 and 2) maximizing the width of the sleeve 24 and hence the seat portion 22 which extends along the length of the sleeve 24, and a fully collapsed state (as shown in FIGS. 3 and 4) minimizing the width of the sleeve 24 and hence the seat portion 22. The sleeve sections 24*a*, 24*b* may also be deployed into any one of a multiplicity of partially expanded states between the fully expanded and collapsed states. As is also apparent from FIG. 1, the length of the area of attachment between the sleeve 24 and the primary belt segment 68 as defined by the stitching 78 and measured between the opposed ends of sleeve 24 is substantially less that the collective lengths of the first and sleeve sections 24*a*, 24*b* in their expanded states.

As best seen in FIG. 2, the carrier 10 also includes an identically configured pair of loop-like anchoring tabs 80 which are attached to and protrude from respective ones of the opposed ends of the sleeve 24 and, more particularly, respective ones of the distal ends of the first and second sleeve sections 24*a*, 24*b*. Each of anchoring tabs 80 has a tab hole disposed therein. The carrier 10 also includes an identically pair of tab attachments and, more particularly, tab buttons 82 which are attached to the primary belt segment 68 of the waist belt 66 proximate respective ones of the opposed ends of the sleeve 24 and, in greater detail, proximate respective ones of the distal ends of the first and second sleeve sections 24*a*, 24*b* when each is stretched into its expanded state. For reasons which will be discussed in more detail below, each of the tab buttons 82 is attached to an anchoring swatch 83 which is applied to the primary belt segment 68 and fabricated from a material differing from the remainder thereof. In the carrier 10, the attachment of one of the anchoring tabs 80 to a respective one of the tab buttons 82 in the manner shown in FIG. 2 is operative to generally maintain a corresponding one of the first and second sleeve sections 24*a*, 24*b* in its fully expanded state. As will be recognized, such attachment is facilitated by advancing each tab button 82 through the tab hole of a corresponding anchor tab 80. Conversely, the detachment of the anchoring tabs 80 from the corresponding tab buttons 82 allows for the collapse of each of the first and second sleeve sections 24*a*, 24*b* into its collapsed state as shown in FIGS. 3 and 4. As indicated above, the receipt of the tab buttons 82 into respective ones of the tab holes defined by the anchor tabs 80 is further operative to prevent the first and second sleeve sections 24*a*, 24*b* from rotating downward under the weight of the legs of an infant being carried in the carrier 10. In this regard, without the first and sleeve sections 24*a*, 24*b* being secured to the primary belt segment 68 through the use of the tab buttons 82, the side edges 28 of the main body panel 12 could otherwise rotate downward resulting in the infant's legs sagging down from a desired horizontal position.

Referring again to FIGS. 1 and 2, the carrier 10 further comprises a pair of leg opening flaps 84 which are attached to the primary belt segment 68 of the waist belt 66 proximate respective ones of the opposed ends of the sleeve 24 and, more particularly, respective ones of the distal ends of the first and second sleeve sections 24*a*, 24*b* when each is stretched into its expanded state. Each of leg opening flaps 84 has a flap hole disposed therein. As is apparent from FIGS. 1-4, each of the leg opening flaps 84 is selectively movable between a stowed state (shown in FIGS. 1 and 3) extending in overlapping relation to a portion of the primary belt segment 68 of the waist belt 66 and covering a respective one of the tab buttons 82, and a deployed state extending from the primary segment 68 of the waist belt 66 into engagement with a respective one of the flap buttons 30 on the outer surface 14 of the main body panel 12. As will be recognized, the attachment of each of the leg opening flaps 84 to a respective one of the flap buttons 30 is facilitated by advancing each flap button 30 through the flap hole of a corresponding leg opening flap 84.

As most apparent from FIG. 4, when the leg opening flaps 84 are moved to the deployed state and attached to respective ones of the flap buttons 30, the main body panel 12 and the leg opening flaps 84 collectively defining a spaced pair of leg openings 86. Typically, the leg opening flaps 84 will be deployed to facilitate the formation of these leg openings 86 when the first and second sleeve sections 24*a*, 24*b* are in some state other than for the fully expanded state in attachment to the tab buttons 82. When, for example, the first and second sleeve sections 24*a*, 24*b* are in the collapsed state shown in FIGS. 3 and 4, the deployed leg opening flaps 84 provided a safeguard for the infant being carried within the carrier 10, assisting in preventing the infant from being able to slip out from one of the side edges 28 between the main body panel 12 and the wearer's body. When, for a larger infant, the safeguards afforded by the deployed leg opening flaps 84 are no longer necessary, they may be moved to their stowed state wherein they advantageously cover or shield respective ones of the tab buttons 82 as indicated above. Along these lines, each of the leg opening flaps 84 preferably includes a small fastening swatch 88 applied to one side of face thereof, each fastening swatch 88 being releasably engageable to a respective one of the anchoring swatches 83 to assist maintaining the corresponding leg opening flap in its stowed state.

In the carrier 10, the main and auxiliary body panels 12, 52 are each preferably fabricated from two opposed layers of a soft yet durable fabric material, the peripheral edges of which are secured to each other through the use of stitching. Additionally, a padded layer is interposed between prescribed areas of these fabric layers. Additionally, those of ordinary skill in the art that attachment modalities other than for buttons and button holes may be substituted for the aforementioned flap button 30, holes in the anchoring tabs 80, tab buttons 82 and holes in the leg opening flaps 84 without departing from the spirit and scope of the present invention.

Based on the structure of the infant carrier 10 as described above, it is suitable for use in a variety of different configurations. In greater detail, the infant carrier 10 is suitable for use in a front carry configuration with the infant facing the wearer's chest or facing outward (narrow seat position and head support folded down), and in a rear carry configuration with the infant facing the wearer's back. In either of the front or rear carry configurations, it is contemplated that seat portion 22 of the main body panel 12 will at least partially overhang or be draped over the sleeve 24 and hence the waist belt 66, with the weight of the infant being transferred not only into the waist belt 66 for distribution into the wearer's hips, but also into the shoulder straps 34 for distribution into each of the wearer's shoulders. In either of these carrying configurations, the effective width of the seat portion 22 can be selectively increased or decreased by the manipulation of the first and second sleeve sections 24*a*, 24*b* into either of the aforementioned expanded or collapsed states, or any partial state of expansion or extension therebetween, as described above. As also previously explained, if warranted by the small size of the infant, the leg opening flaps 84 may also be transitioned from their stowed to their deployed states for purposes of defining the aforementioned leg openings 86. Still further, the auxiliary body panel 52 attached to the main body panel 12 may be selectively manipulated between its extended and folded states in the aforementioned manner as may be need to properly support the head of the infant within the carrier 10. Because they are outfitted with the length adjusting modalities described above, the effective lengths of both the shoulder straps 34 and the waist belt 66 may be selectively increased or decreased as needed to achieve a proper fit of the carrier 10 to the wearer based not only on the wearer's physical attributes, but those of the infant to be carried as well. In this regard, as will be recognized, the adaptability of the carrier 10 to the infant's physical features is further enhanced by the width adjustability of the seat portion 22, as well as the optional deployment of the leg opening flaps 84 and the folding/unfolding of the auxiliary body panel 52.

Those of ordinary skill in the art will recognize that the carrier 10 may be outfitted with a shoulder strap arrangement differing from that described above without necessarily departing from the spirit and scope of the present invention. By way of example, the carrier 10 may include a shoulder strap arrangement similar to that described in Applicant's U.S. Patent Publication No. 2015/0374139 entitled INFANT CARRIER WITH EXPANDABLE SEAT published Dec. 31, 2015 and corresponding to U.S. application Ser. No. 14/315,817 filed Jun. 26, 2014, the disclosure of which is incorporated herein by reference. In this regard, it is contemplated that those end portions of the primary segments 36 of the shoulder straps 34 attached to respective ones of the corner regions 20 of the main body panel 12 may alternatively be connected to a separate connecting panel similar to the connecting panel 32 as described in Ser. No. 14/315,817, such connecting panel in turn being attached to the waist belt 66 and, with the main body panel 12, collectively defining a pouch like structure for accommodating the infant.

Referring now to FIGS. 9-14, there is shown an infant carrier 110 constructed in accordance with another embodiment of the present disclosure. Like the carrier 10, the infant carrier 110 is outfitted with a structural features described with particularity below which are adapted to allow for varying degrees of adjustability to the effective width of the seat portion of the carrier 110 so as to accommodate children of differing size, as well as different support positions/configurations.

The carrier 110 comprises a main body panel 112 defining an exteriorly presented outer surface 114, and an opposed, interiorly presented inner surface 116. When viewed from the perspective shown in FIG. 9, the main body panel 112 further defines an arcuately contoured, generally convex top edge segment 118, the opposed ends of which terminate at respective ones of a spaced pair of corner regions 120. In this regard, the top edge segment 118 and corner regions 120 collectively define the top edge of the main body panel 112. As also viewed from the perspective shown in FIG. 9, approximately the lower third of the main body panel 112 defines a seat portion 122 thereof, the use of which will be described in more detail below.

Figure 9:
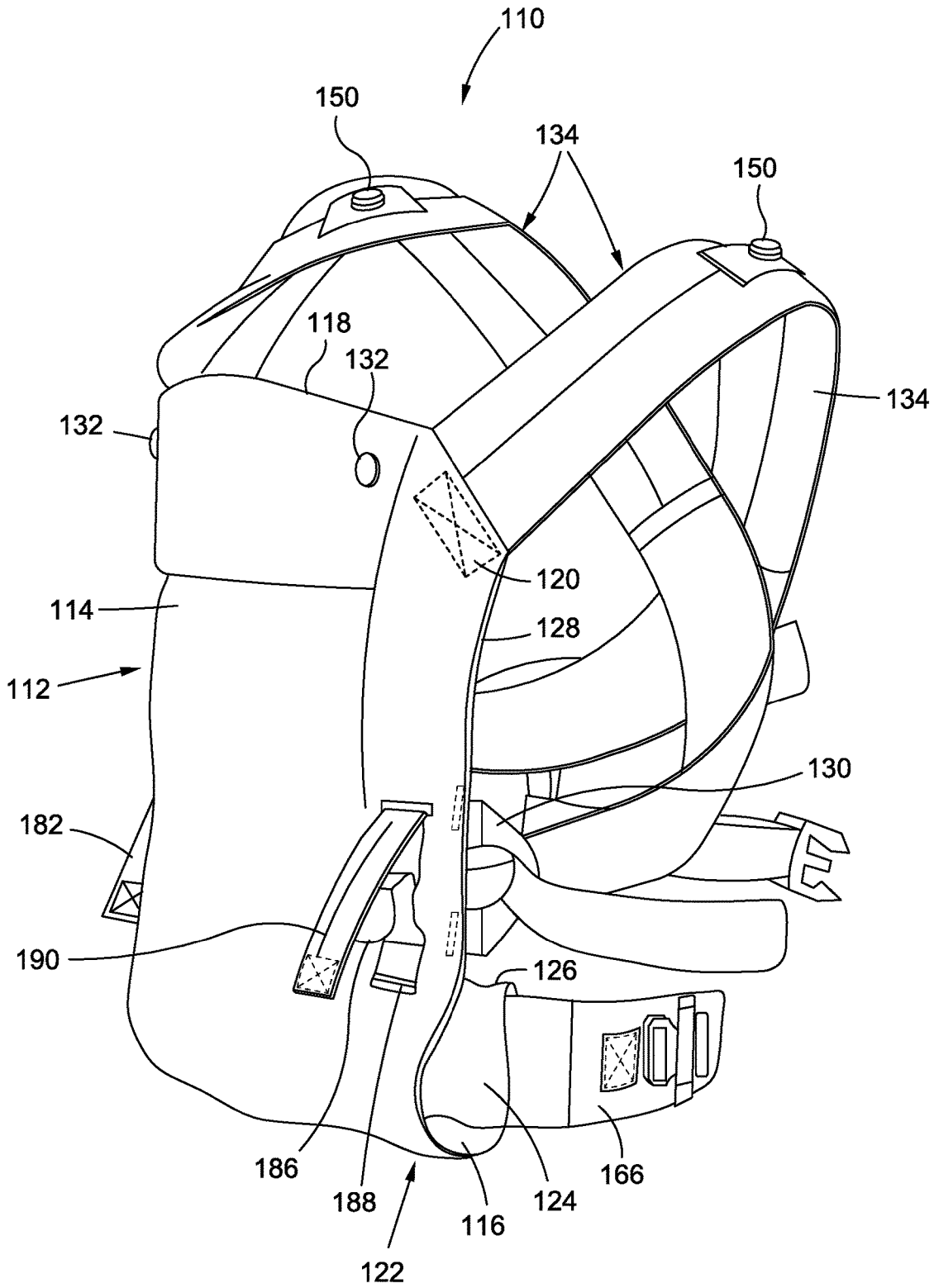
FIG. 9 is a front perspective view of an adjustable infant carrier constructed in accordance with another embodiment of the present disclosure.

The main body panel 112 further includes an elongate, tubular sleeve 124 which, as also viewed from the perspective shown in FIG. 9, extends along the length of the lower edge or boundary of the seat portion 122, the sleeve 124 and the seat portion 122 thus being of substantially equal width. In the carrier 110, the sleeve 124 defines the bottom edge 126 of the main body panel 112. The main body panel 112 further defines an opposed pair of side edges 128 which each extend between the top edge of the main body panel 112 as collectively defined by the top edge segment 118 and corner regions 120, and the bottom edge 126 as defined by the sleeve 124. Those of ordinary skill in the art will recognize that the sleeve 124 may comprise an independent structure attached to the remainder of the main body panel 112, or may be defined by a portion of the main body panel 112.

In the carrier 110, disposed on the outer surface 114 of the main body panel 112 is an identically configured, horizontally aligned pair of connectors and, more particularly, female snaps 132. In greater detail, each of the snaps 132 is attached to the outer surface 114 in relative close proximity to the top edge segment 118 of the main body panel 112. The use of the snaps 132 will be described in more detail below. The carrier 110 also includes an identically configured pair of fabric loops 130 (as shown in FIG. 9) or, alternatively, metal rings 130*a* (as shown in FIGS. 10-14), which are attached to respective ones of the side edges 128 approximately midway between the top edge segment 118 and the bottom edge 126. When the rings 130*a* are used in the carrier 110 as an alternative to the loops 130, fabric loops 131 similar to the loops 130 are used facilitate the operative engagement of the rings 130*a* to respective ones of the side edges 128.

The carrier 110 further comprises an identically configured pair of elongate shoulder straps 134 which are adapted to be extensible over respective ones of the wearer's shoulders. Each of the shoulder straps 134 preferably has a two-piece construction. In greater detail, each of the shoulder straps 134 comprises a primary segment 136 which is of a relatively wide and relatively thick padded construction, preferably fabricated from two opposed layers of a soft yet durable fabric material having a padded layer therebetween, the peripheral edges of the fabric layers being secured to each other through the use of stitching. As is most apparent from FIGS. 9-10, one end portion of the primary segment 136 of each shoulder strap 134 is attached to a respective one of the corner regions 120 of the main body panel 112.

In addition to the primary segment 136, each shoulder strap 134 includes a secondary segment 138 which is of a narrower and thinner construction in comparison to the corresponding primary segment 136. Within each shoulder strap 134, one end portion of the secondary segment 138 is attached to that end portion of the corresponding primary segment 136 opposite the end portion attached to a respective one of the corner regions 120. The attachment of the primary and secondary segments 136, 138 of each shoulder strap 134 to each other, and to the main body panel 112, is preferably facilitated through the use of stitching. In the carrier 110, the secondary segments 138 of the shoulder straps 134 are extensible through respective ones of the loops 130 or rings 130*a*. In greater detail, the secondary segment 138 of each shoulder strap 134 is extensible through that loop 130 or ring 130*a* attached to the side edge 128 which is opposite the side edge 128 extending to the corner region 120 to which such shoulder strap 134 is attached via the aforementioned stitching. After being extended through corresponding ones of the loops 130 or rings 130*a*, the free end portions of the secondary segments 138 of the shoulder straps 134 may be tied to each other at the front or back of the wearer in a sash-like arrangement as effectively maintains the carrier 110 on the wearer's body.

As seen in FIG. 9, the primary segment 136 of each of the shoulder straps 134 also includes a connector and, more particularly, a female snap 150 attached to the exterior surface thereof. The use of the snaps 150 will also be described in more detail below.

Figure 10:
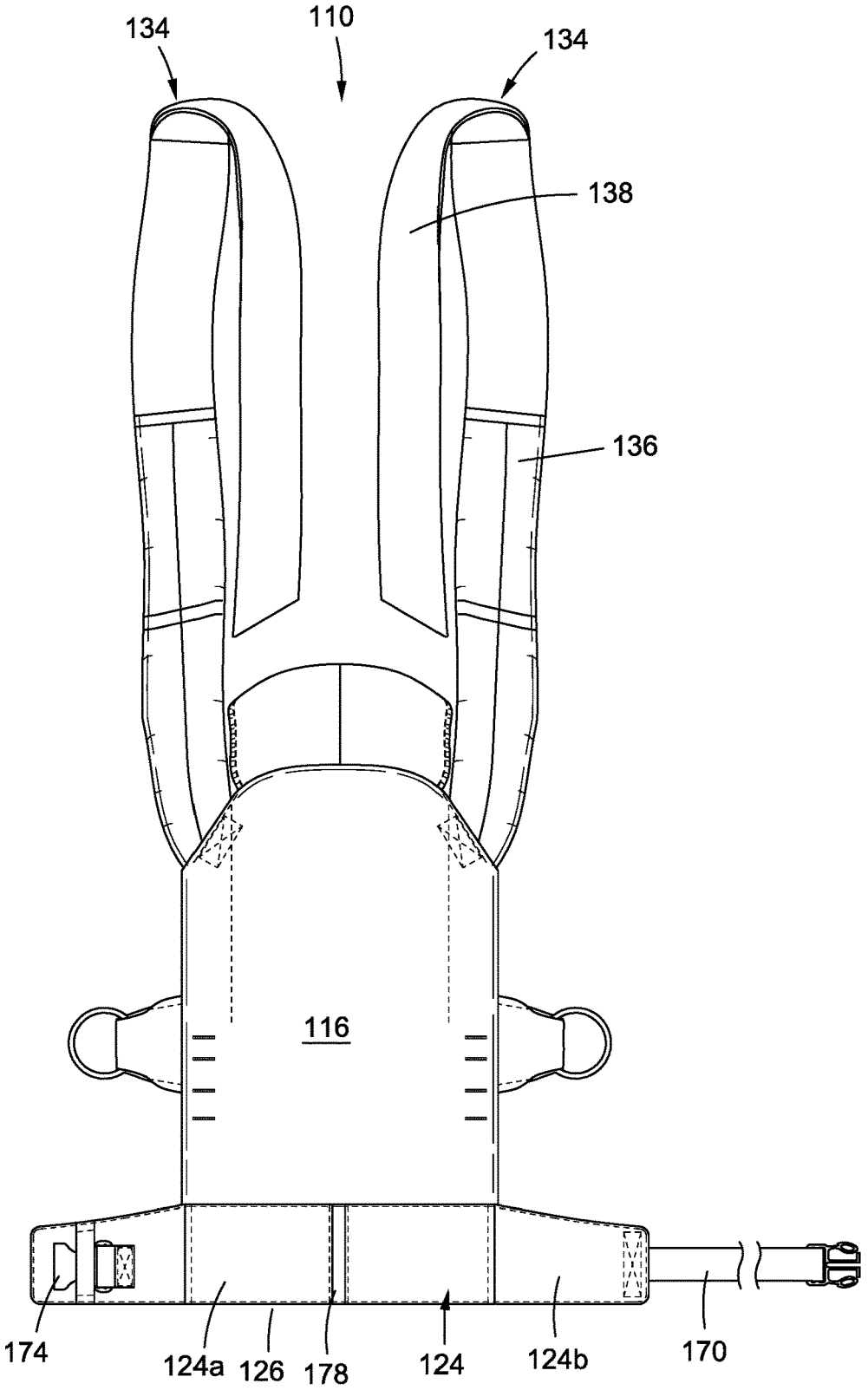
FIG. 10 is a rear view of the infant carrier shown in FIG. 9.
Figure 11:
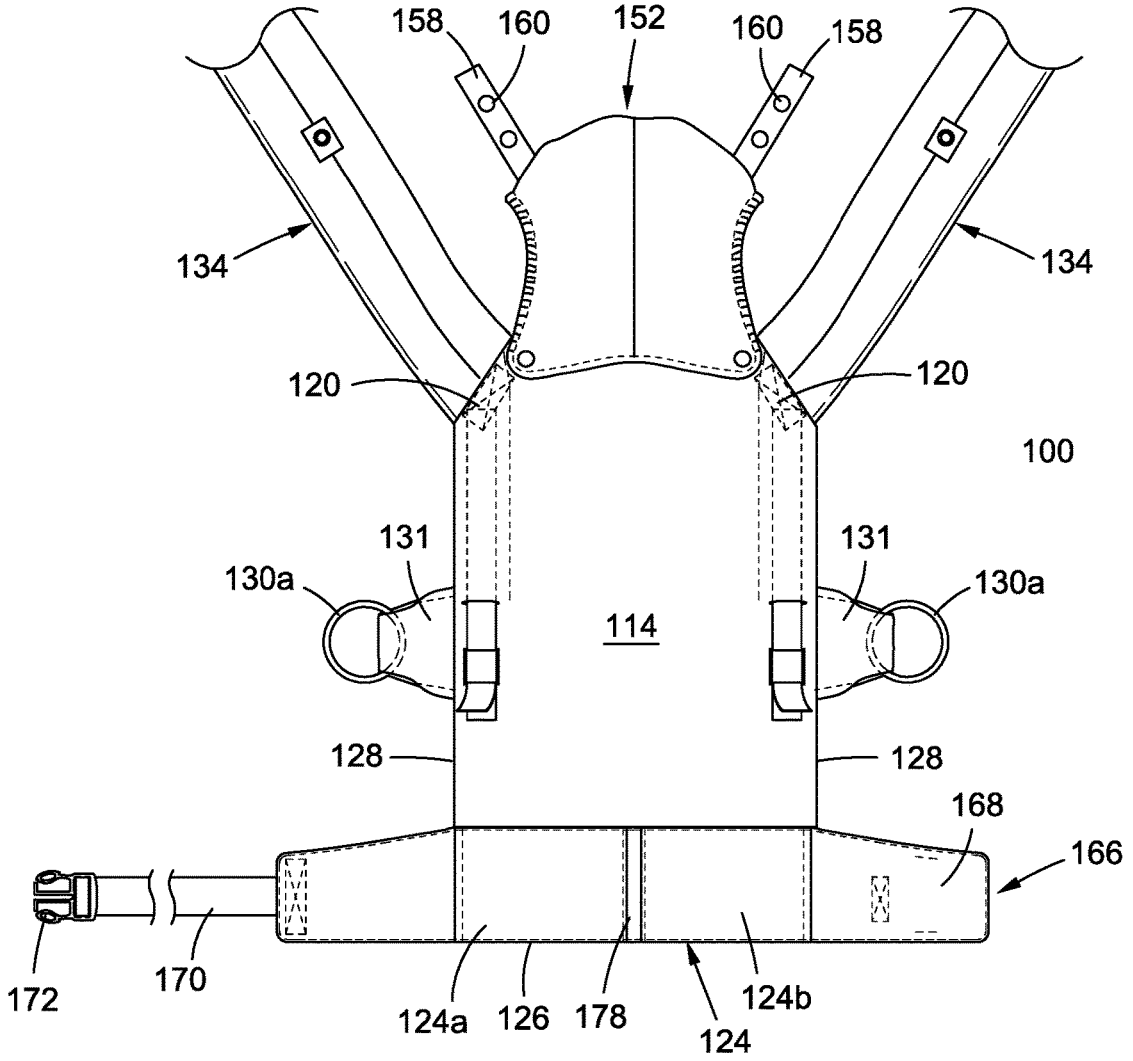
FIG. 11 is a front view of the infant carrier shown in FIGS. 9 and 10.

As seen in FIGS. 10-11, the carrier 110 may be optionally outfitted with a removable hood panel 152 which is preferably fabricated from a fabric material, and attachable to the main body panel 112 and shoulder straps 134. In greater detail, the hood panel 152 comprises a main panel portion 154 which is sized and configured to be extensible over an infant's head. Disposed on the main panel portion 154 is an identically configured pair of connectors and, more particularly, male snaps 156 which are oriented so as to be releasably engageable to respective ones the snaps 132 included on the outer surface 114 of the main body panel 112. The hood panel 152 also includes and identically configured pair of elongate strap portions 158 which are attached to and protrude from corresponding corner regions defined by the main panel portion 154. Each of the strap portions 158 is provided with a series of connectors and, more particularly, male snaps 160 which extend in linear alignment along a common side thereof, and are each releasably engageable to the snap 150 of a respective one of the shoulder straps 134.

The carrier 110 further comprises an elongate waist belt 166 which it is extensible about the waist of a wearer. The waist belt 166 preferably comprises a primary belt segment 168 which is of a relatively wide and relatively thick padded construction, preferably fabricated from two opposed layers of the soft yet durable fabric material having a padded letter therebetween, the peripheral edges of the fabric layers being secured to each other through the use of stitching. The waist belt 166 also includes a coupling belt segment 170 which is attached to and protrudes from one end portion of the primary belt segment 168, and is of a narrower and thinner construction in comparison to the primary belt segment 168. Attached to and selectively positionable along the length of the coupling belt segment 170 is a male connector 172 which is releasably engageable to a complementary female connector 174 attached to that end portion of the primary belt segment 168 opposite that having the coupling belt segment 170 protruding therefrom. As will be recognized, the coupling of the male and female connectors 172, 174 to each other effectively maintains the waist belt 166 in a closed-loop configuration, the circumference of which can be selectively increased or decreased through the adjustments of the positioning of the male connector 172 on the coupling belt segment 170.

In the carrier 110, the main body panel 112, and in particular the sleeve 124 thereof, is adjustably attached to a waist belt 166. In greater detail, the primary belt segment 168 of the waist belt 166 is advanced through the sleeve 124. Importantly, as seen in FIGS. 10-11, in the carrier 110, a central portion of the sleeve 124 is rigidly attached to the primary belt segment 168 of the waist belt 166, preferably through the use of stitching 178. Such attachment assists in preventing the rotation of the sleeve 124 about the primary belt segment 168 advanced therethrough, and further results in the sleeve 124 defining separate first and second sleeve sections 124*a*, 124*b* which are each slidably, adjustably positionable along a corresponding portion of the primary belt segment 168. In greater detail, each of the first and second sleeve sections 124*a*, 124*b* is movable between a fully expanded state (shown in FIGS. 10 and 11) maximizing the width of the sleeve 124 and hence the seat portion 122 which extends along the length of the sleeve 124, and a fully collapsed state (as shown in FIGS. 3 and 4 regarding the carrier 10) minimizing the width of the sleeve 124 and hence the seat portion 122. The sleeve sections 124*a*, 124*b* may also be deployed into any one of a multiplicity of partially expanded states between the fully expanded and collapsed states. As is also apparent from FIGS. 10 and 11, the length of the area of attachment between the sleeve 124 and the primary belt segment 168 as defined by the stitching 178 and measured between the opposed ends of the sleeve 124 is substantially less that the collective lengths of the first and sleeve sections 124*a*, 124*b* in their expanded states.

Referring now to FIGS. 9 and 11-14, in the carrier 110, the main body panel 112 is outfitted with a spaced pair of height adjustment strap assemblies 180. Each of these strap assemblies 180 comprises an elongate adjustment strap 182 which is advanced through a corresponding, complimentary sleeve 184. Each sleeve 184 extends vertically within the main body panel 112 proximate and in generally parallel relation to a corresponding one of the side edges 128. One end portion of each adjustment strap 182 extends and is attached to the main body panel 112 at a corresponding one of the corner regions 120. The opposite end portion of each adjustment strap 182, which is free floating, protrudes from an open end of the corresponding sleeve 184 and is cooperatively engaged to a corresponding retention cam 186 included in each strap assembly 180. The retention cam 186 of each strap assembly 180 is attached the outer surface 114 of the main body panel 112 via a corresponding cam strap 188 also included in each strap assembly 180.

Figure 12:
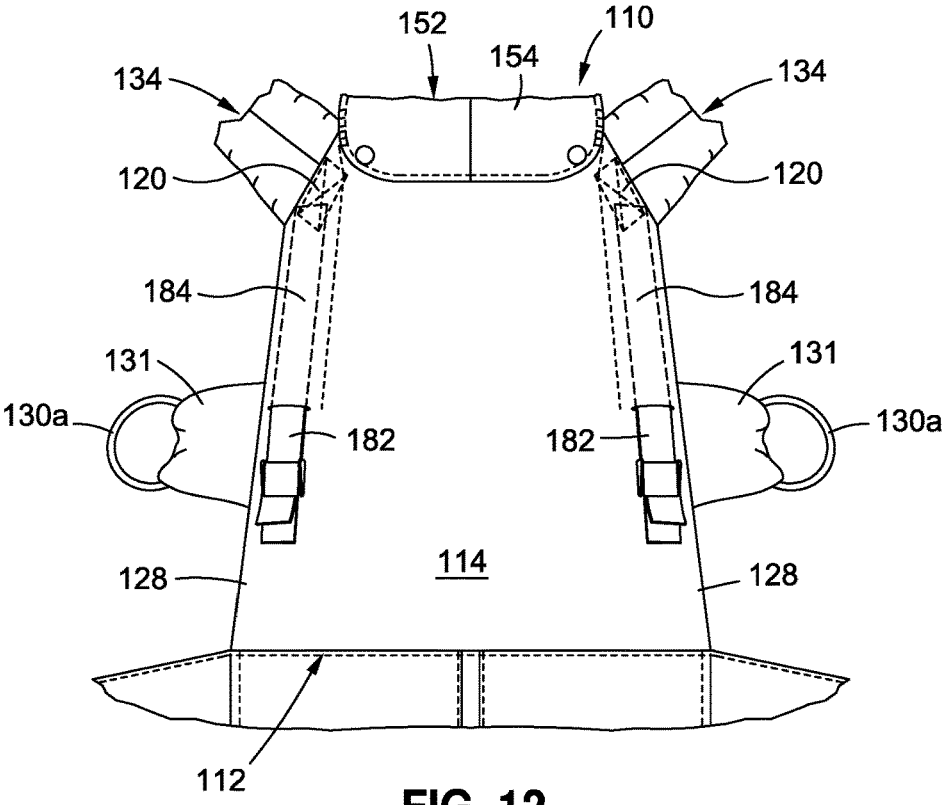
FIG. 12 is a front view of the infant carrier similar to FIG. 11, but with an enlarged depiction of the height adjustment strap assemblies integrated into the main body panel, and manipulated so that the main body panel assumes its fully stretched or expanded profile as shown in FIGS. 10 and 11.
Figure 13:
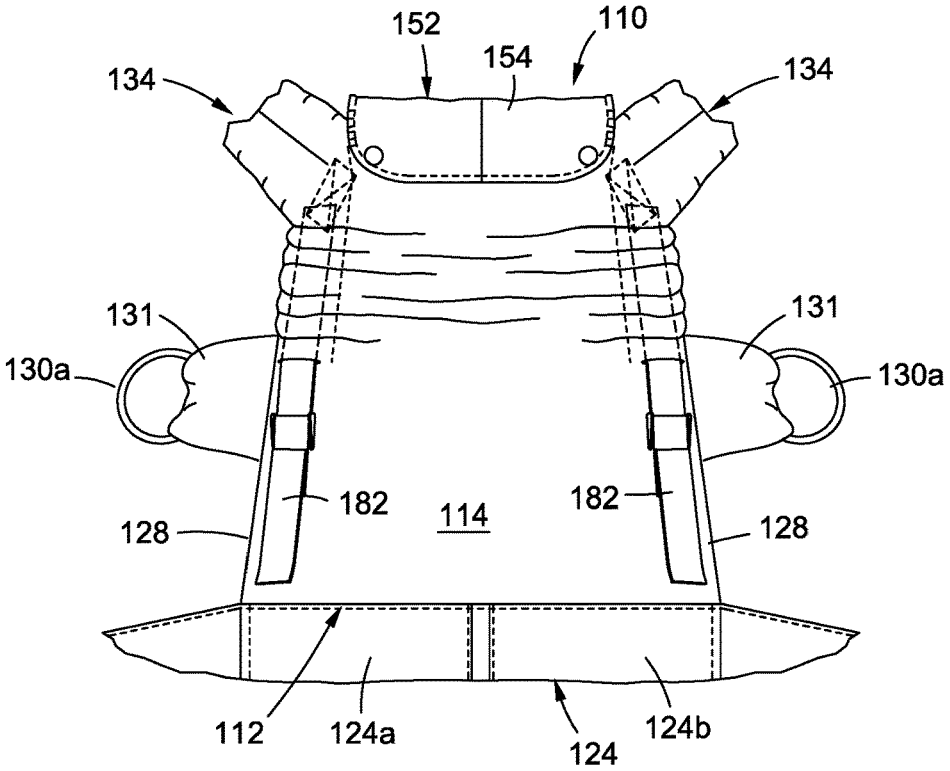
FIG. 13 is a front view of the infant carrier similar to FIG. 12, but depicting the height adjustment strap assemblies integrated into the main body panel being manipulated so that the main body panel is cinched into a reduced height profile.
Figure 14:
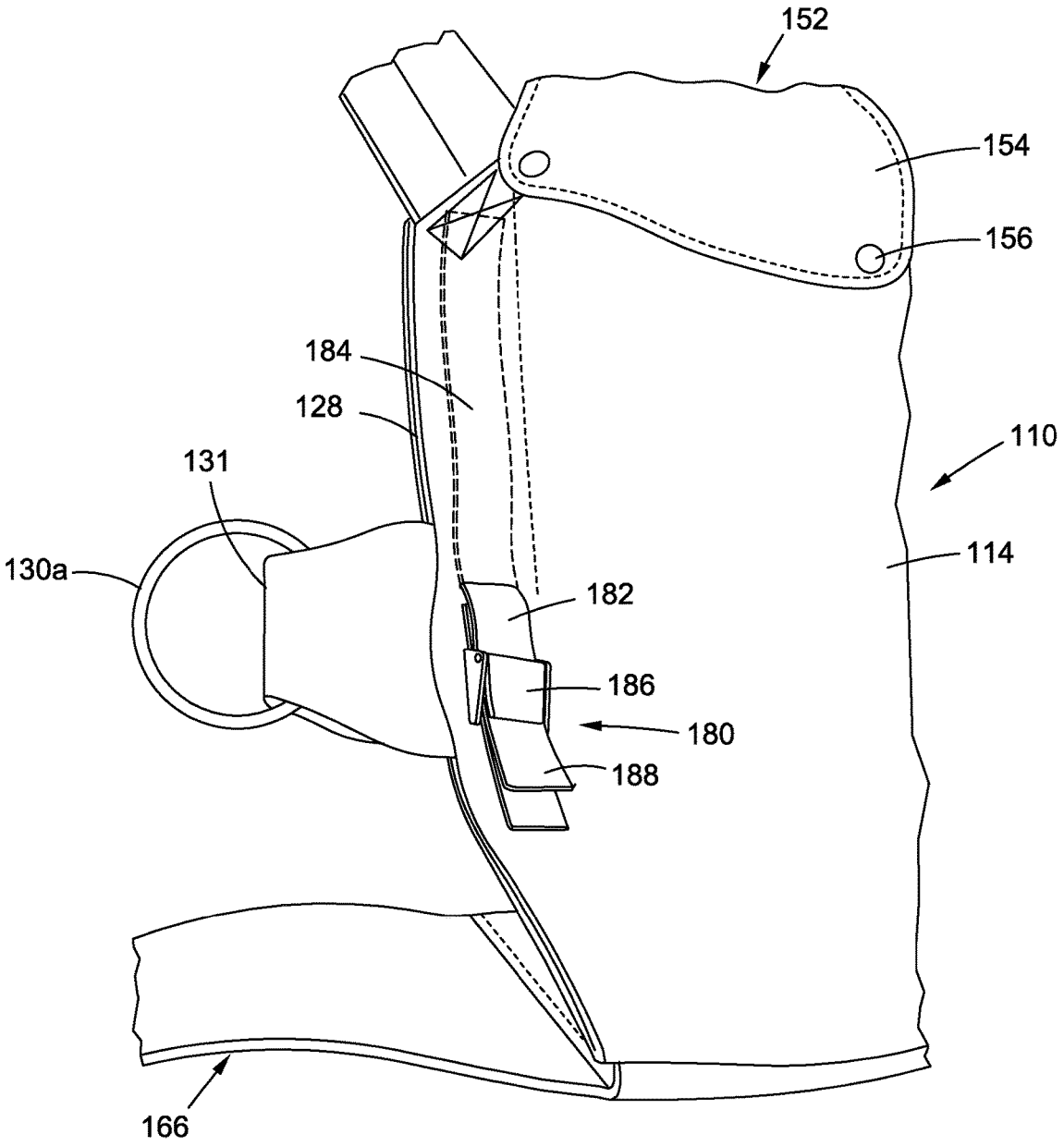
FIG. 14 is a partial front view of the infant carrier shown in FIGS. 9-13, further depicting the manipulation of the waist into an overlapping state relative to the lower portion of the main body panel as occurs when the carrier is worn by a wearer.

Each retention cam 186 is selectively movable between locked and unlocked positions. The movement of the retention cam 186 to the unlocked position allows the corresponding adjustment strap 182 to pulled therethrough in either of two opposite directions as allows for the selective cinching of the main body panel 112 into a reduced height profile (FIG. 13) or, conversely, the stretching or expansion of the main body panel into a full height profile (FIGS. 11-12). The movement of the retention cam 186 of each strap assembly 180 to its locked position effectively maintains the main body panel 112 in its particular height profile corresponding to the relative position of the adjustment strap 182 thereto. As will be recognized, the manipulation of the main body panel 112 into any particular height profile is facilitated by manipulating both of the strap assemblies 180 such that orientations of the locked retention cams 186 along the lengths of the corresponding adjustment straps 182 is approximately the same. To assist in this relative positioning, each of the adjustment straps 182 is provided with colored lines of demarcation preferably defined by spaced, parallel segments 190 of colored thread. In this regard, aligning the retention cams 186 with common segments 190 on the adjustment straps 182 helps insure that the main body panel 112 is cinched to a similar degree adjacent each of the side edges 128.

In the carrier 110, the main body panel 112 is preferably fabricated from two opposed layers of a soft yet durable fabric material, the peripheral edges of which are secured to each other through the use of stitching. Additionally, a padded layer is interposed between prescribed areas of these fabric layers. Further, in using the carrier 110, it is contemplated that prior to the waist belt 166 being secured about the waist of the wearer, the waist belt 166 and sleeve 124 will be turned or folded upwardly from the orientation shown in FIGS. 10 and 11 to the orientation shown in FIGS. 9 and 14 wherein the sleeve 124 overlaps a portion of the inner surface 116 of the main body panel 112. When the carrier 110 is properly worn, the seat portion 122 of the main body panel 112 will effectively transfer the weight of the infant not only into the waist belt 166 via the sleeve 124 for distribution into the wearer's hips, but also into the shoulder straps 134 for distribution into each of the wearer's shoulders. The effective width of the seat portion 122 can be selectively increased or decreased by the manipulation of the first and second sleeve sections 124*a*, 124*b* into either of the aforementioned expanded or collapsed states, or any partial state of expansion or extension therebetween, as described above. In this regard, as will be recognized, the adaptability of the carrier 110 to the infant's physical features is further enhanced by the width adjustability of the seat portion 122.

Referring now to FIGS. 15-21, there is shown an infant carrier 210 constructed in accordance with yet another embodiment of the present disclosure. Like the carriers 10, 110, the infant carrier 210 is outfitted with a structural features described with particularity below which are adapted to allow for varying degrees of adjustability to the effective width of the seat portion of the carrier 210 so as to accommodate children of differing size, as well as different support positions/configurations.

The carrier 210 comprises a main body panel 212 defining an exteriorly presented outer surface 214, and an opposed, interiorly presented inner surface 216. When viewed from the perspective shown in FIGS. 20 and 21, the main body panel 212 further defines an arcuately contoured, generally convex top edge segment 218, the opposed ends of which terminate at respective ones of a spaced pair of corner regions 220 also defined by the main body panel 212. As also viewed from the perspective shown in FIG. 21, approximately the lower third of the main body panel 212 defines a seat portion 222 thereof, the use of which will be described in more detail below.

Figure 15:
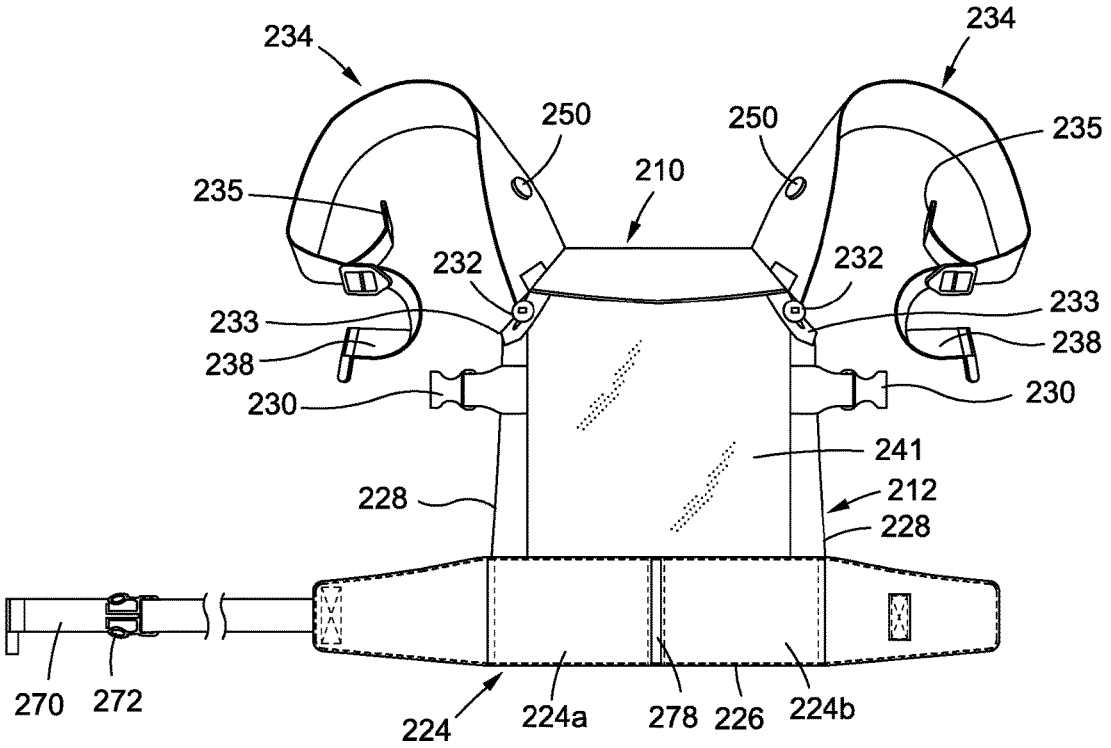
FIG. 15 is a front elevational view of an adjustable infant carrier constructed in accordance with yet another embodiment of the present disclosure, depicting the seat portion of the carrier at its maximum width.

The main body panel 212 further includes an elongate, tubular sleeve 224 which, as also viewed from the perspective shown in FIG. 15, extends along the length of the lower edge or boundary of the seat portion 222, the sleeve 224 and the seat portion 222 thus being of substantially equal width. In the carrier 210, the sleeve 224 defines the bottom edge 226 of the main body panel 212. The main body panel 212 further defines an opposed pair of side edges 228 which each extend between respective ones of the corner regions 220 of the main body panel 212 and the bottom edge 226 as defined by the sleeve 224. Those of ordinary skill in the art will recognize that the sleeve 224 may comprise an independent structure attached to the remainder of the main body panel 212, or may be defined by a portion of the main body panel 212.

Figure 16:
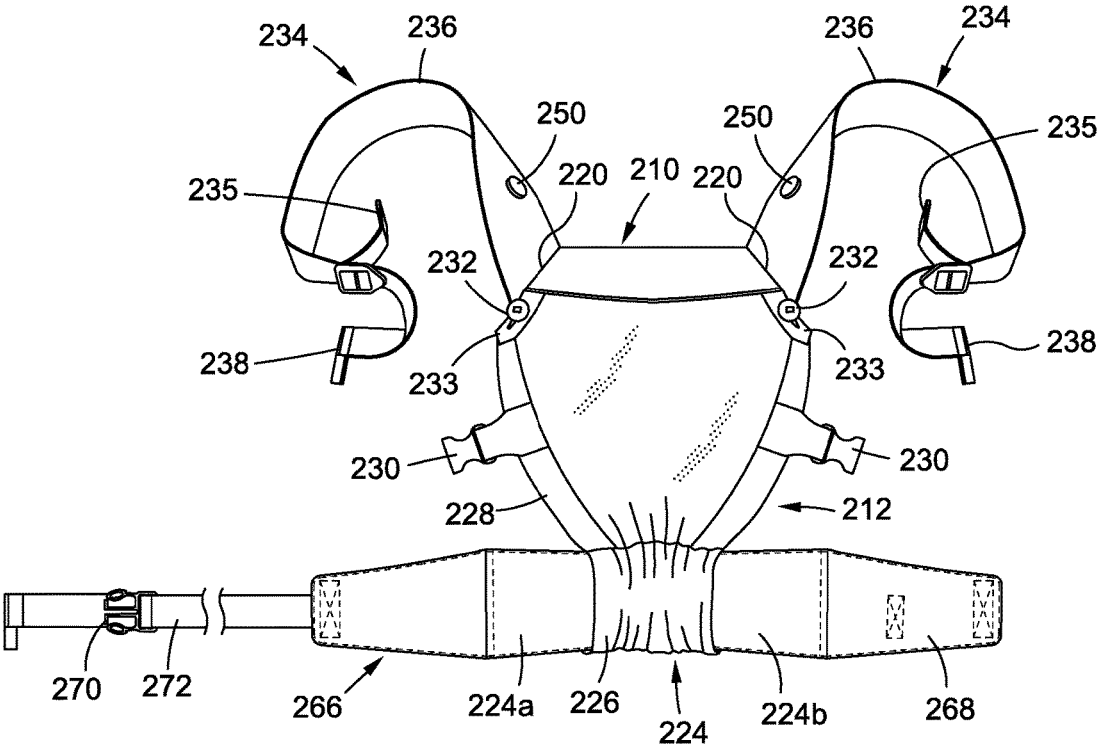
FIG. 16 is a front elevational view of an adjustable infant carrier shown in FIG. 15, but depicting the seat portion of the carrier at its minimum width.
Figure 19:
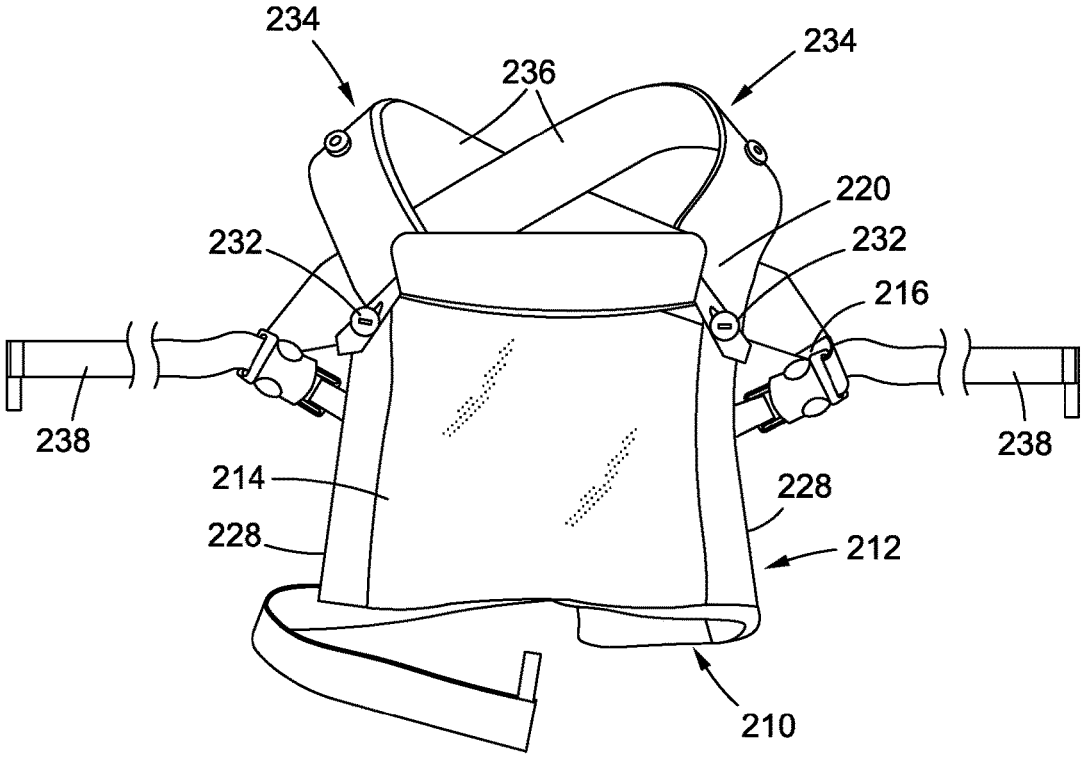
FIG. 19 is a front view of the infant carrier shown in FIG. 18.

In the carrier 210, disposed on the outer surface 214 of the main body panel 212 proximate respective ones of the corner regions 220 is an identically configured, horizontally aligned pair of connectors and, more particularly, buttons 232. The carrier 210 also includes an identically configured pair of fabric loops 233 which protrude from the top edge segment 218 of the main body panel 212 is spaced relation to other, each of the loops 233 being proximate to but spaced from a respective one of the corner regions 220. When viewed from the perspective shown in FIG. 21, the uppermost portion of the main body panel 212 which defines the top edge segment 218 further defines a head support portion of the main body panel 212. This head support portion is selectively movable between an extended configuration (shown in FIGS. 20 and 21) and a folded configuration (shown in FIGS. 15, 16 and 19) wherein it is disposed in overlapping relation to a portion of the outer surface 214. As seen in FIGS. 15, 16 and 19, the head support portion of the main body panel 212 is maintained in its folded configuration by the advancement of respective ones of the buttons 232 through corresponding ones of the loops 233.

The carrier 210 also includes an identically configured pair of connectors and, more particularly, female connectors 230 which are attached to respective ones of the side edges 228 approximately midway between the top edge segment 218 (when the head support portion of the main body panel 212 is extended or unfolded) and the bottom edge 226. In the carrier 210, the female connectors 230 are preferably provided in respective ones of two different colors for reasons which will be discussed in greater detail below. By way of example and not by way of limitation, as viewed from the perspective shown in FIGS. 15 and 16, the female connector 230 to the right may be provided in an aqua green color, with the female connector 230 to the left being provided in a purple color.

The carrier 210 further comprises an identically configured pair of elongate shoulder straps 234 which are adapted to be extensible over respective ones of the wearer's shoulders. Each of the shoulder straps 234 preferably has a two-piece construction. In greater detail, each of the shoulder straps 234 comprises a primary segment 236 which is of a relatively wide and relatively thick padded construction, preferably fabricated from two opposed layers of a soft yet durable fabric material having a padded layer therebetween, the peripheral edges of the fabric layers being secured to each other through the use of stitching. As is most apparent from FIGS. 15-18, one end portion of the primary segment 236 of each shoulder strap 234 is attached to a respective one of the corner regions 220 of the main body panel 212.

In addition to the primary segment 236, each shoulder strap 234 includes a secondary segment 238 which is of a narrower and thinner construction in comparison to the corresponding primary segment 236. Within each shoulder strap 234, one end portion of the secondary segment 238 is attached to that end portion of the corresponding primary segment 236 opposite the end portion attached to a respective one of the corner regions 220. The attachment of the primary and secondary segments 236, 238 of each shoulder strap 234 to each other, and to the main body panel 212, is preferably facilitated through the use of stitching.

In the carrier 210, cooperatively engaged to respective ones of the secondary segments 238 of the shoulder straps 234 are corresponding ones of an identically configured pair of connectors and, more particularly, male connectors 235. In the carrier 210, like the female connectors 230, the male connectors 235 are also preferably provided in respective ones of two different colors. By way of example and not by way of limitation, as viewed from the perspective shown in FIGS. 15 and 16, the male connector 235 to the right may be provided in a purple color, with the male connector 235 to the left being provided in an aqua green color, i.e., the preferred color pattern for the right and left male connectors 235 is the opposite of the color pattern for the right and left female connectors 230. By making the color patterns opposite, the wearer is reminded to wear the shoulder straps 234 in the intended arrangement, i.e., in a crisscross pattern across the wearer's back. In this regard, by attaching the exemplary aqua green male connector 235 to the corresponding aqua green female connector 230, and attaching the exemplary purple male connector 235 to the corresponding purple female connector 230, the shoulder straps 234 will be effectively crisscrossed over the wearer's back. In contrast, if the exemplary aqua green male connector 235 were to be attached to the purple female connector 230 at the common side of the carrier 210, and the exemplary purple male connector 235 were to be attached to the aqua green female connector 230 at the common side of the carrier 210, the shoulder straps 234 would simply form respective ones of two different loops disposed along respective ones of the opposed side edges 228. Though the carrier 210 could still be worn in this arrangement, the aforementioned crisscross arrangement is preferred. In each shoulder strap 234, the interface of the male connectors 235 to respective ones of the secondary segments 238 is accomplished through the use of modalities, e.g., buckles, as allows for selective modification to the operative lengths of the shoulder straps 234, i.e., lengthening or shortening depending on wearer size of preference.

Figure 20:
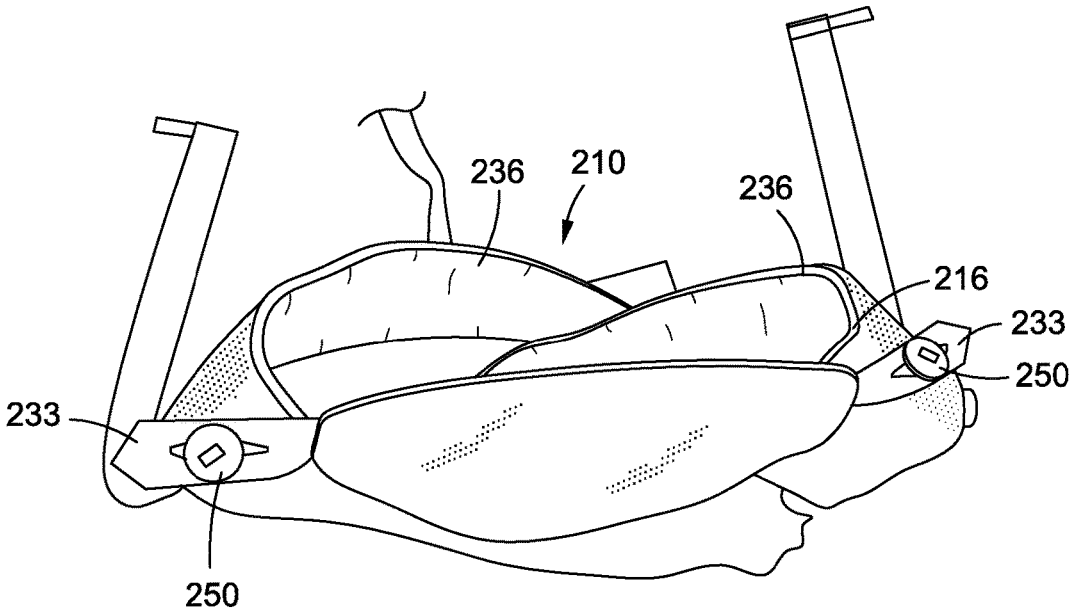
FIG. 20 is a top view of the infant carrier shown in FIGS. 18 and 19 with the waist belt of the carrier in its looped configuration and the shoulder straps of the carrier being cooperatively engaged to the main body panel, but further depicting a head supporting portion of the main body panel in its extended rather than in its folded state.
Figure 21:
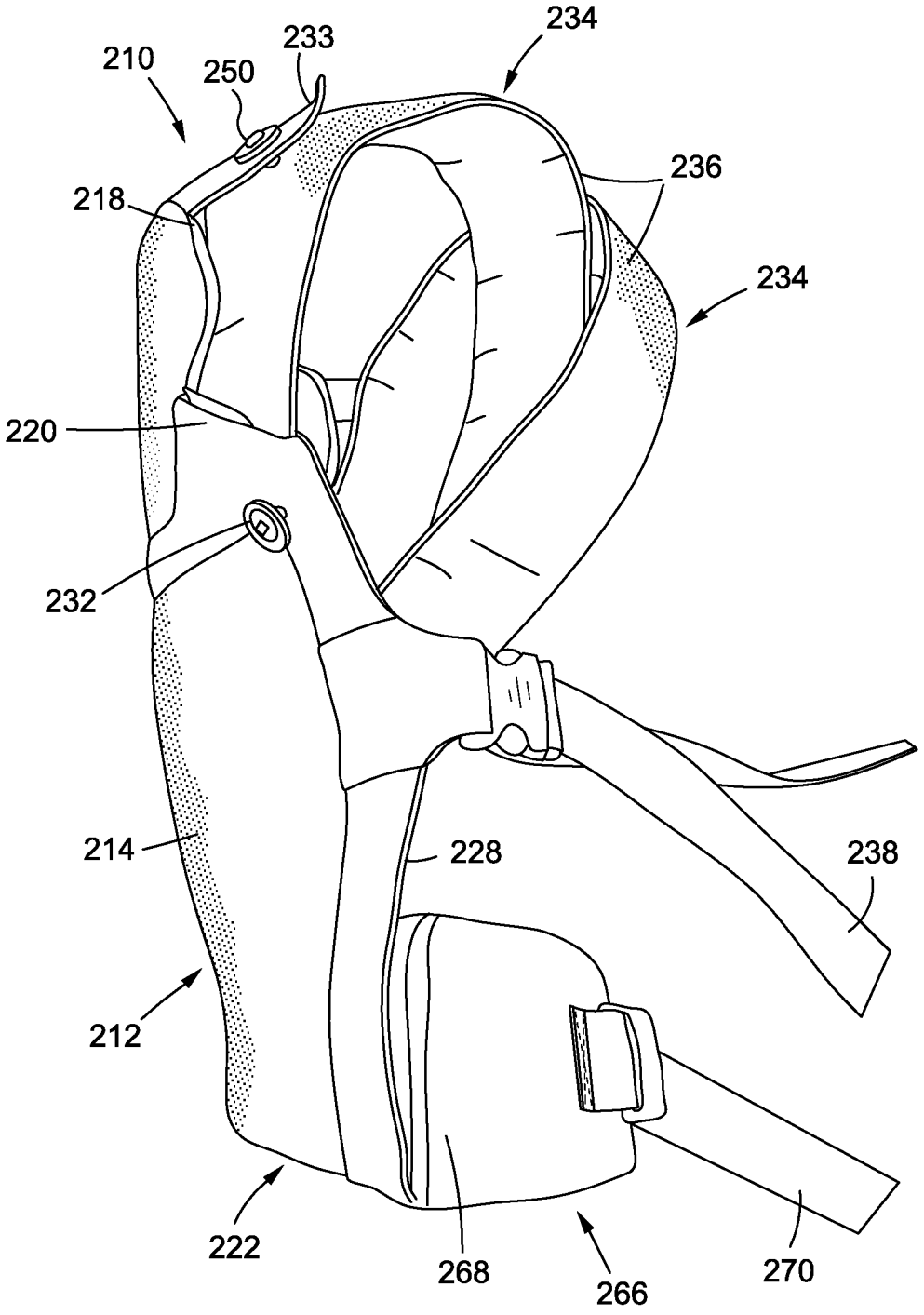
FIG. 21 is a side elevational view of the infant carrier shown in FIG. 20.

As seen in FIGS. 15-16 and 20-21, the primary segment 236 of each of the shoulder straps 234 also includes a connector and, more particularly, a button 250 attached to the exterior surface thereof. The use of the snaps 150 will also be described in more detail below. As seen in FIGS. 20 and 21, the head support portion of the main body panel 212 is maintained in its extended configuration by the advancement of respective ones of the buttons 250 through corresponding ones of the loops 233.

The carrier 210 further comprises an elongate waist belt 266 which it is extensible about the waist of a wearer. The waist belt 266 preferably comprises a primary belt segment 268 which is of a relatively wide and relatively thick padded construction, preferably fabricated from two opposed layers of the soft yet durable fabric material having a padded letter therebetween, the peripheral edges of the fabric layers being secured to each other through the use of stitching. The waist belt 266 also includes a coupling belt segment 270 which is attached to and protrudes from one end portion of the primary belt segment 268, and is of a narrower and thinner construction in comparison to the primary belt segment 268. Attached to and selectively positionable along the length of the coupling belt segment 270 is a male connector 272 which is releasably engageable to a complementary female connector 274 attached to that end portion of the primary belt segment 268 opposite that having the coupling belt segment 270 protruding therefrom. As will be recognized, the coupling of the male and female connectors 272, 274 to each other effectively maintains the waist belt 266 in a closed-loop configuration, the circumference of which can be selectively increased or decreased through the adjustments of the positioning of the male connector 272 on the coupling belt segment 270.

Figure 17:
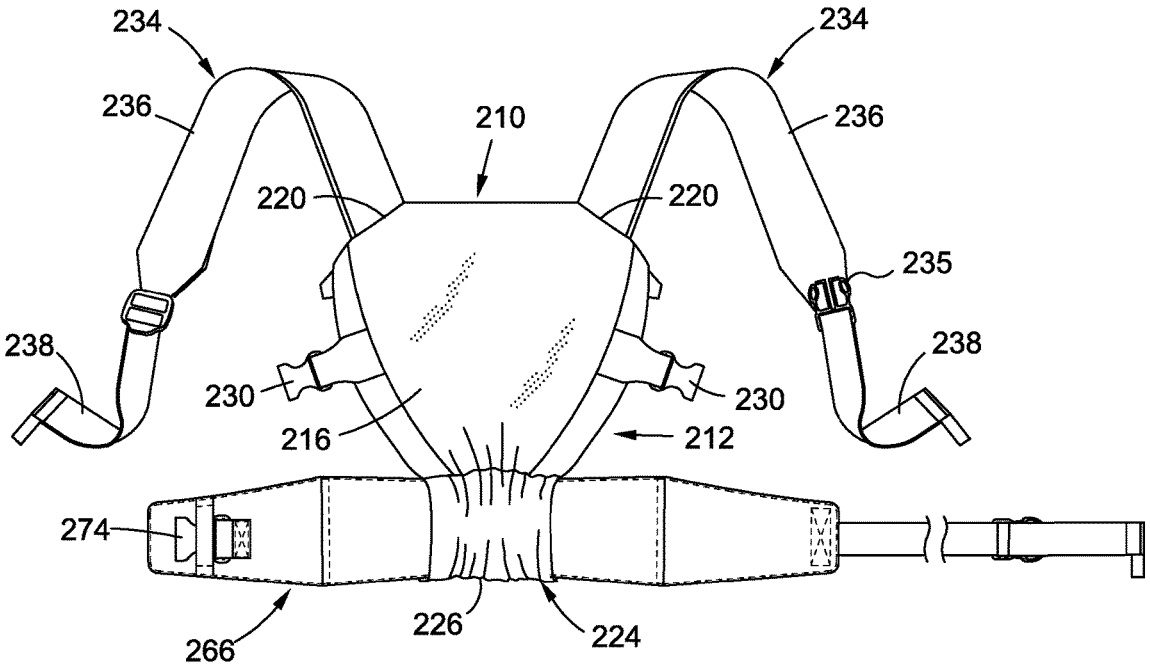
FIG. 17 is a rear view of the infant carrier shown in FIG. 16.
Figure 18:
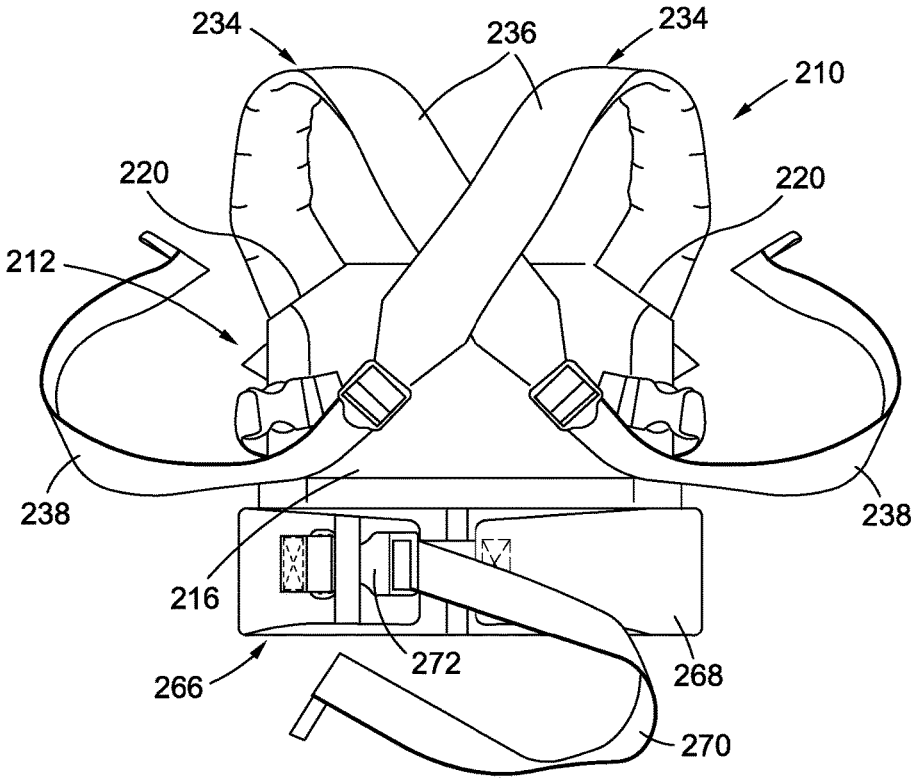
FIG. 18 is a rear view of the infant carrier shown in FIG. 15, but further depicting the waist belt of the carrier in its looped configuration, and the shoulder straps of the carrier as cooperatively engaged to the main body panel.

In the carrier 210, the main body panel 212, and in particular the sleeve 224 thereof, is adjustably attached to a waist belt 266. In greater detail, the primary belt segment 268 of the waist belt 266 is advanced through the sleeve 224. Importantly, as seen in FIGS. 15-17, in the carrier 210, a central portion of the sleeve 224 is rigidly attached to the primary belt segment 268 of the waist belt 266, preferably through the use of stitching 278. Such attachment assists in preventing the rotation of the sleeve 224 about the primary belt segment 268 advanced therethrough, and further results in the sleeve 224 defining separate first and second sleeve sections **224*a*, 224*b* which are each slidably, adjustably positionable along a corresponding portion of the primary belt segment 268. In greater detail, each of the first and second sleeve sections 224*a*, 224*b* is movable between a fully expanded state (shown in FIG. 15) maximizing the width of the sleeve 224 and hence the seat portion 222 which extends along the length of the sleeve 224, and a fully collapsed state (as shown in FIGS. 16 and 17) minimizing the width of the sleeve 224 and hence the seat portion 222. The sleeve sections 224*a*, 224*b* may also be deployed into any one of a multiplicity of partially expanded states between the fully expanded and collapsed states. As is also apparent from FIG. 15, the length of the area of attachment between the sleeve 224 and the primary belt segment 268 as defined by the stitching 278 and measured between the opposed ends of the sleeve 224 is substantially less that the collective lengths of the first and sleeve sections 224*a*, 224*b*** in their expanded states.

In the carrier 210, the main body panel 212 is preferably fabricated from two opposed layers of a soft yet durable fabric material, the peripheral edges of which are secured to each other through the use of stitching. Additionally, a padded layer is interposed between prescribed areas of these fabric layers. Further, in using the carrier 210, it is contemplated that prior to the waist belt 266 being secured about the waist of the wearer, the waist belt 266 and sleeve 224 will be turned or folded upwardly from the orientation shown in FIGS. 15-17 to the orientation shown in FIG. 21 wherein the sleeve 224 overlaps a portion of the inner surface 216 of the main body panel 212. When the carrier 210 is properly worn, the seat portion 222 of the main body panel 212 will effectively transfer the weight of the infant not only into the waist belt 266 via the sleeve 224 for distribution into the wearer's hips, but also into the shoulder straps 234 for distribution into each of the wearer's shoulders. The effective width of the seat portion 222 can be selectively increased or decreased by the manipulation of the first and second sleeve sections 224*a*, 224*b* into either of the aforementioned expanded or collapsed states, or any partial state of expansion or extension therebetween, as described above. In this regard, as will be recognized, the adaptability of the carrier 210 to the infant's physical features is further enhanced by the width adjustability of the seat portion 222.

This disclosure provides exemplary embodiments of the present invention. The scope of the present disclosure is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An adjustable infant carrier wearable by a user for carrying an infant, the infant carrier comprising:

a main body panel at least partially defining a seat portion;

an elongate sleeve which extends at least partially along the seat portion, the sleeve including opposed top and bottom ends and opposed side ends;

a waist belt extensible about the waist of a wearer and including a portion advanced through the sleeve; and a pair of shoulder straps extensible over the shoulders of the wearer and each operatively coupled to the main body panel;

wherein a central portion of the sleeve is fixedly attached solely to the waist belt and is of a prescribed height between the opposed top and bottom ends of the sleeve and is of a prescribed width between the opposed side ends of the sleeve such that the sleeve defines separate first and second sleeve sections on opposite sides of the central portion which are each slidably, adjustably positionable along a corresponding portion of the waist belt advanced therethrough between a fully expanded state maximizing the width of the seat portion, a fully collapsed state minimizing the width of the seat portion, and any one of a multiplicity of partially expanded states between the fully expanded and collapsed states.

2. The adjustable infant carrier of claim 1 wherein each of the first and second sleeve sections is outfitted with an anchoring mechanism operative to facilitate the releasable attachment thereof to the waist belt to maintain the fully expanded state.

3. The adjustable infant carrier of claim 1, further comprising:

a pair of leg opening flaps attached to the waist belt proximate respective ones of the first and second sleeve sections;

each of the leg opening flaps being selectively movable between a stowed state in releasable attachment to the waist belt, and a deployed state in releasable attachment to the main body panel, the leg opening flaps and the main body panel collectively defining a spaced pair of leg openings when the leg opening flaps are each in the deployed state.

4. The adjustable infant carrier of claim 1, further comprising:

an auxiliary body panel which is connected to the main body panel and is foldable relative thereto from an extended state to a folded state;

the auxiliary body panel at least partially overlapping the main body panel when in the folded state, with the main and auxiliary body panels collectively defining a pocket.

5. The adjustable infant carrier of claim 1, further comprising:

a pair of height adjustment strap assemblies integrated into the main body panel;

the strap assemblies being sized and configured to allow for the selective cinching of the main body panel into a reduced height profile or, conversely, the expansion of the main body panel into a full height profile.

6. The adjustable infant carrier of claim 5, wherein each of the strap assemblies comprises:

an elongate adjustment strap which is advanced through a corresponding, complimentary sleeve defined by the main body panel, one end portion of the adjustment strap being attached to a prescribed region of the main body panel; and a retention cam attached to a prescribed region of the main body panel and selectively movable between locked and unlocked positions;

the adjustment strap protruding from the corresponding sleeve and being cooperatively engaged to the retention cam such that movement of the retention cam to the unlocked position allows the adjustment strap to pulled therethrough in either of two opposite directions as allows for the selective cinching or expansion of the main body panel.

7. The adjustable infant carrier of claim 1, wherein each of the shoulder straps comprises opposed first and second ends portions which are each coupled to respective, prescribed regions of the main body panel.

8. The adjustable infant carrier of claim 7 wherein:

the main body panel has a top edge defining a spaced pair of corner regions, and opposed side edges which extend to respective ones of the corner regions;

the first end portion of each of the shoulder straps is attached to a respective one of the corner regions; and the second end portion of each of the shoulder straps is releasably attached to a respective one of the side edges which extends to the corner region having the first end portion of the same shoulder strap attached thereto.

9. The adjustable infant carrier of claim 7 wherein:

the main body panel has a top edge defining a spaced pair of corner regions, and opposed side edges which extend to respective ones of the corner regions;

the first end portion of each of the shoulder straps is attached to a respective one of the corner regions; and the second end portion of each of the shoulder straps is releasably attached to a respective one of the side edges which is opposite to the corner region having the first end portion of the same shoulder strap attached thereto.

10. An adjustable infant carrier wearable by a user for carrying an infant, the infant carrier comprising:

a main body panel defining a seat portion and an elongate sleeve which extends along the seat portion and includes opposed top and bottom ends and opposed side ends;

a waist belt advanced through the sleeve and extensible about the waist of a wearer; and a pair of shoulder straps extensible over the shoulders of the wearer and each having opposed first and second ends portions, the first end portions being coupled to respective, prescribed regions of the main body panel;

wherein a central portion of the sleeve is fixedly attached solely to the waist belt and is of a prescribed height between the opposed top and bottom ends of the sleeve and is of a prescribed width between the opposed side ends of the sleeve such that the sleeve defines separate first and second sleeve sections on opposite sides of the central portion which are each slidably, adjustably positionable along the waist belt between a fully expanded state maximizing the width of the seat portion, a fully collapsed state minimizing the width of the seat portion, and any one of a multiplicity of partially expanded states between the fully expanded and collapsed states.

11. The adjustable infant carrier of claim 10 wherein each of the first and second sleeve sections is outfitted with an anchoring mechanism operative to facilitate the releasable attachment thereof to the waist belt to maintain the fully expanded state.

12. The adjustable infant carrier of claim 10, further comprising:

a pair of leg opening flaps attached to the waist belt proximate respective ones of the opposed ends of the sleeve;

each of the leg opening flaps being selectively movable between a stowed state in releasable attachment to the waist belt, and a deployed state in releasable attachment to the main body panel, the leg opening flaps and the main body panel collectively defining a spaced pair of leg openings when the leg opening flaps are each in the deployed state.

13. The adjustable infant carrier of claim 10, further comprising:

an auxiliary body panel which is connected to the main body panel and is foldable relative thereto from an extended state to a folded state;

the auxiliary body panel at least partially overlapping the main body panel when in the folded state, with the main and auxiliary body panels collectively defining a pocket.

14. The adjustable infant carrier of claim 10, further comprising:

a pair of height adjustment strap assemblies integrated into the main body panel;

the strap assemblies being sized and configured to allow for the selective cinching of the main body panel into a reduced height profile or, conversely, the expansion of the main body panel into a full height profile.

15. The adjustable infant carrier of claim 14, wherein each of the strap assemblies comprises:

an elongate adjustment strap which is advanced through a corresponding, complimentary sleeve defined by the main body panel, one end portion of the adjustment strap being attached to a prescribed region of the main body panel; and a retention cam attached to a prescribed region of the main body panel and selectively movable between locked and unlocked positions;

the adjustment strap protruding from the corresponding sleeve and being cooperatively engaged to the retention cam such that movement of the retention cam to the unlocked position allows the adjustment strap to pulled therethrough in either of two opposite directions as allows for the selective cinching or expansion of the main body panel.

16. The adjustable infant carrier of claim 10 wherein:

the main body panel has a top edge defining a spaced pair of corner regions, and opposed side edges which extend to respective ones of the corner regions;

the first end portion of each of the shoulder straps is attached to a respective one of the corner regions; and the second end portion of each of the shoulder straps is releasably attached to a respective one of the side edges which extends to the corner region having the first end portion of the same shoulder strap attached thereto.

17. The adjustable infant carrier of claim 10 wherein:

the main body panel has a top edge defining a spaced pair of corner regions, and opposed side edges which extend to respective ones of the corner regions;

the first end portion of each of the shoulder straps is attached to a respective one of the corner regions; and the second end portion of each of the shoulder straps is releasably attached to a respective one of the side edges which is opposite to the corner region having the first end portion of the same shoulder strap attached thereto.

18. An adjustable infant carrier wearable by a user for carrying an infant, the infant carrier comprising:

a main body panel at least partially defining a seat portion;

an elongate sleeve which extends at least partially along the seat portion and includes opposed top and bottom ends and opposed side ends;

a waist belt advanced through the sleeve and extensible about the waist of a wearer; and a pair of shoulder straps extensible over the shoulders of the wearer and each operatively coupled to the main body panel;

wherein a central portion of the sleeve is fixedly attached solely to the waist belt and is of a prescribed height between the opposed top and bottom ends of the sleeve and is of a prescribed width between the opposed side ends of the sleeve such that the sleeve defines separate first and second sleeve sections on opposite sides of the central portion which are each slidably, adjustably positionable along the waist belt between a fully expanded state maximizing the width of the seat portion, a fully collapsed state minimizing the width of the seat portion, and any one of a multiplicity of partially expanded states between the fully expanded and collapsed states.

19. The adjustable infant carrier of claim 18, further comprising:

a pair of height adjustment strap assemblies integrated into the main body panel;

the strap assemblies being sized and configured to allow for the selective cinching of the main body panel into a reduced height profile or, conversely, the expansion of the main body panel into a full height profile.

20. The adjustable infant carrier of claim 1, wherein the fixed attachment of the elongated sleeve to the waist belt comprises stitching.

* * * * *